US005421265A

United States Patent [19]

Sugimoto et al.

[11] Patent Number: 5,421,265

[45] Date of Patent: Jun. 6, 1995

[54] TRUCK WHEEL-SPACING CHANGING METHOD, AND VARIABLE WHEEL-SPACING TRUCK, AND GROUND FACILITY THEREFOR

[75] Inventors: Sunao Sugimoto; Mitsuji Yoshino; Noboru Kobayashi, all of Kobe, Japan

[73] Assignee: Kawasaki Jukogyo Kabushiki Kaisha, Kobe, Japan

[21] Appl. No.: 139,175

[22] Filed: Oct. 21, 1993

[30] Foreign Application Priority Data

Oct. 21, 1992 [JP] Japan ..... 4-308151
Oct. 21, 1992 [JP] Japan ..... 4-308152

[51] Int. Cl.[6] ..... B61F 5/00

[52] U.S. Cl. ..... 104/33; 105/178

[58] Field of Search ..... 104/33, 32.1; 105/178

[56] References Cited

U.S. PATENT DOCUMENTS

| | | | |
|---|---|---|---|
| 79,252 | 6/1868 | Parrott | 104/33 |
| 105,984 | 8/1870 | Sanford | 104/33 |
| 173,000 | 2/1876 | Hall et al. | 105/178 |
| 903,654 | 11/1908 | Angus | 104/33 |
| 1,108,467 | 8/1914 | Newton | 104/33 |
| 3,403,637 | 10/1968 | Lich | 104/33 |

FOREIGN PATENT DOCUMENTS

| | | | |
|---|---|---|---|
| 2738046 | 3/1978 | Germany . | |
| 0016326 | of 0000 | Italy | 104/33 |
| 54-47221 | 4/1979 | Japan . | |
| 18292 | 11/1911 | United Kingdom . | |
| 1173069 | 12/1969 | United Kingdom . | |

OTHER PUBLICATIONS

"Talgo Trains on Two Gauges", The Railway Gazette, Feb. 21, 1969, pp. 136–142.

*Primary Examiner*—Mark T. Le
*Attorney, Agent, or Firm*—Leydig, Voit & Mayer

[57] ABSTRACT

A variable wheel-spacing truck includes a pair of left and right bogie frames which are transversely movable relative to each other and can be fixedly connected with each other by releasable locking devices. At least one of the wheels is slidable relative to the wheel shaft in an axial direction of the shaft. When the truck moves from one railway onto a junction railway of a different track gauge, running paths push auxiliary wheels of the locking devices upwards to release the locking devices. When the truck moves through the junction railway section, a pair of guide rails or a pair of rails push the wheels of the truck, thereby laterally shifting the left and right bogie frames relative to each other. After a predetermined relative transverse movement of the bogie frames and wheels is completed, the running paths lower the auxiliary wheels of the locking devices, thereby activating the locking devices into a locking condition. Then, the truck is moved out of the junction railway, thereby completing a truck wheel-spacing changing operation.

10 Claims, 35 Drawing Sheets

NARROW TRACK GAUGE
A
B
C
D
E
F
G

FIG. 8A
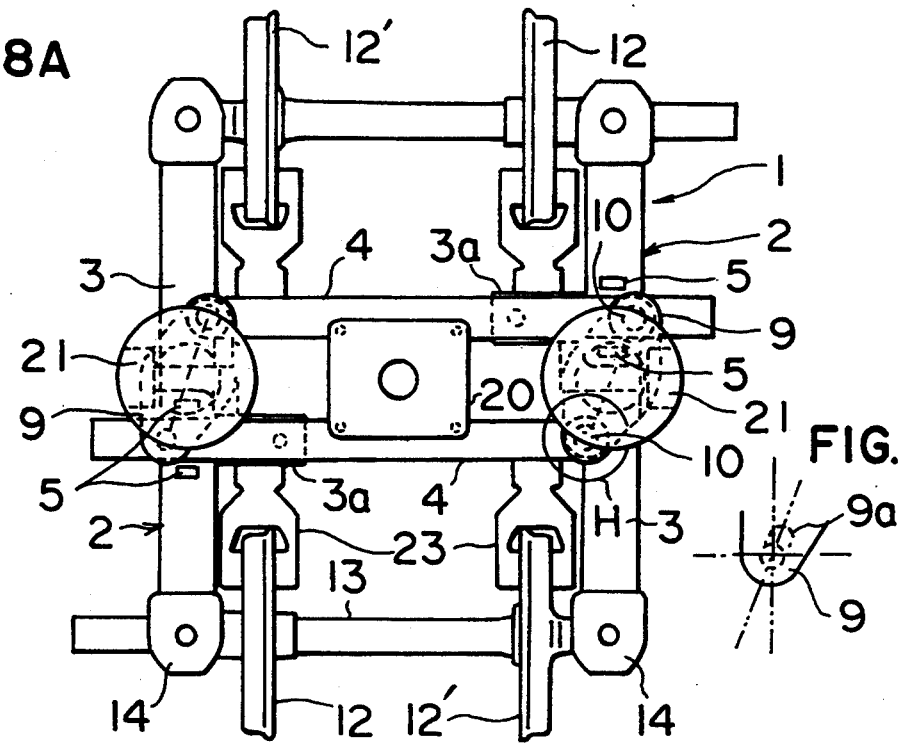
FIG. 8C
FIG. 8B
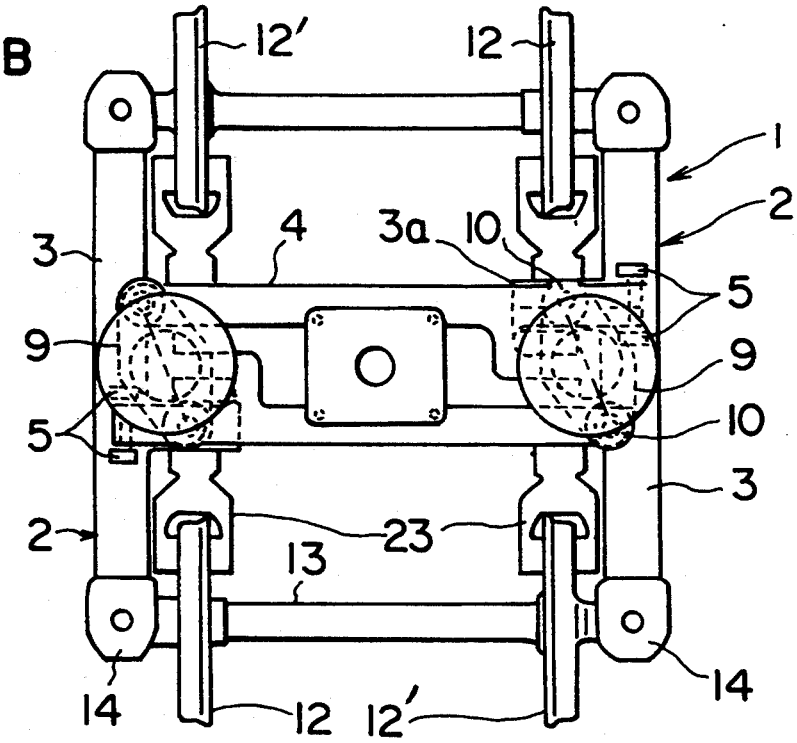

FIG. 17A
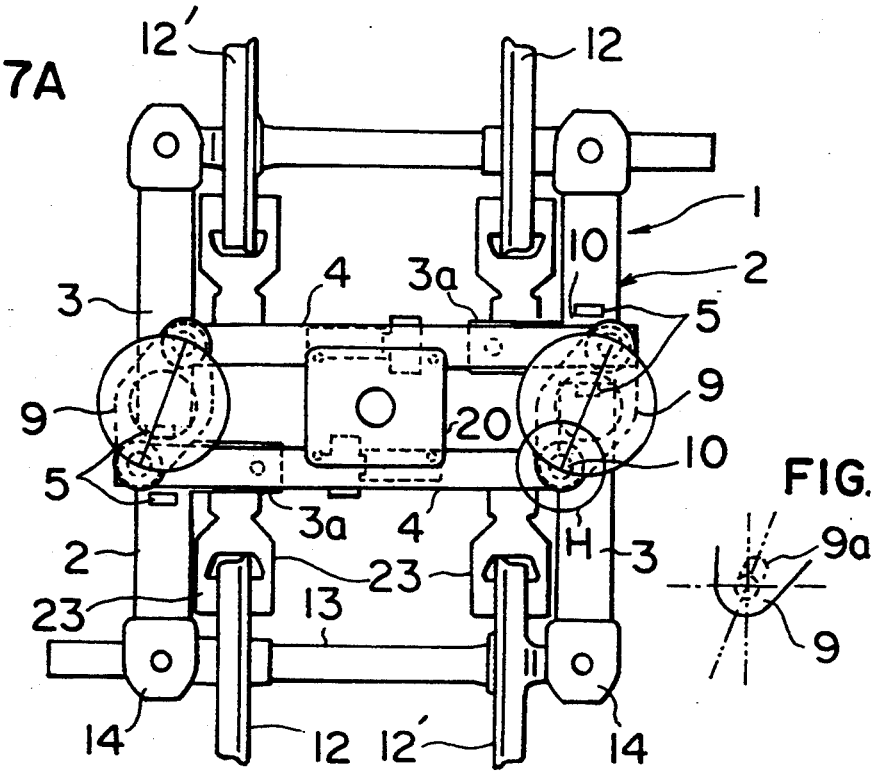
FIG. 17C
FIG. 17B
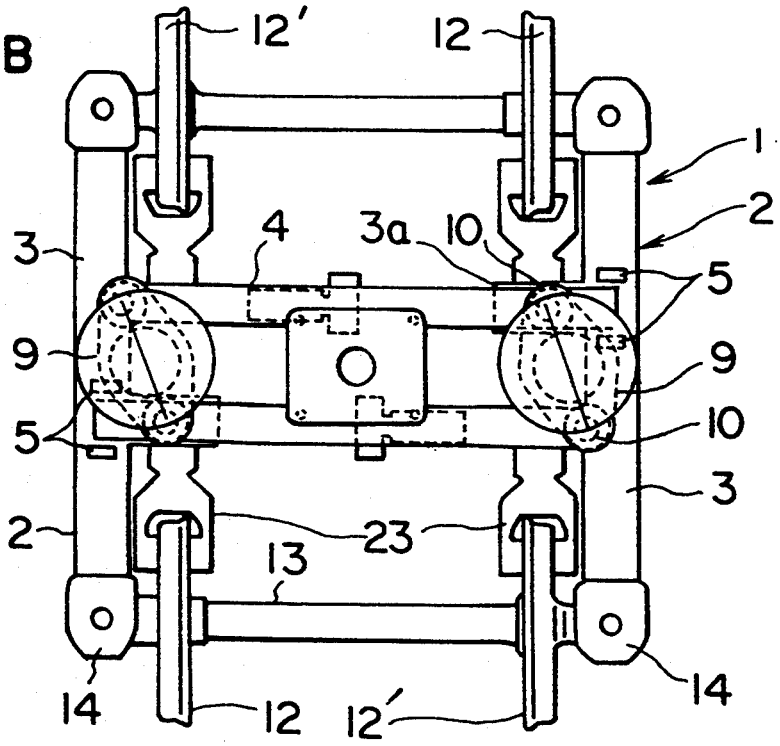

FIG. 33A
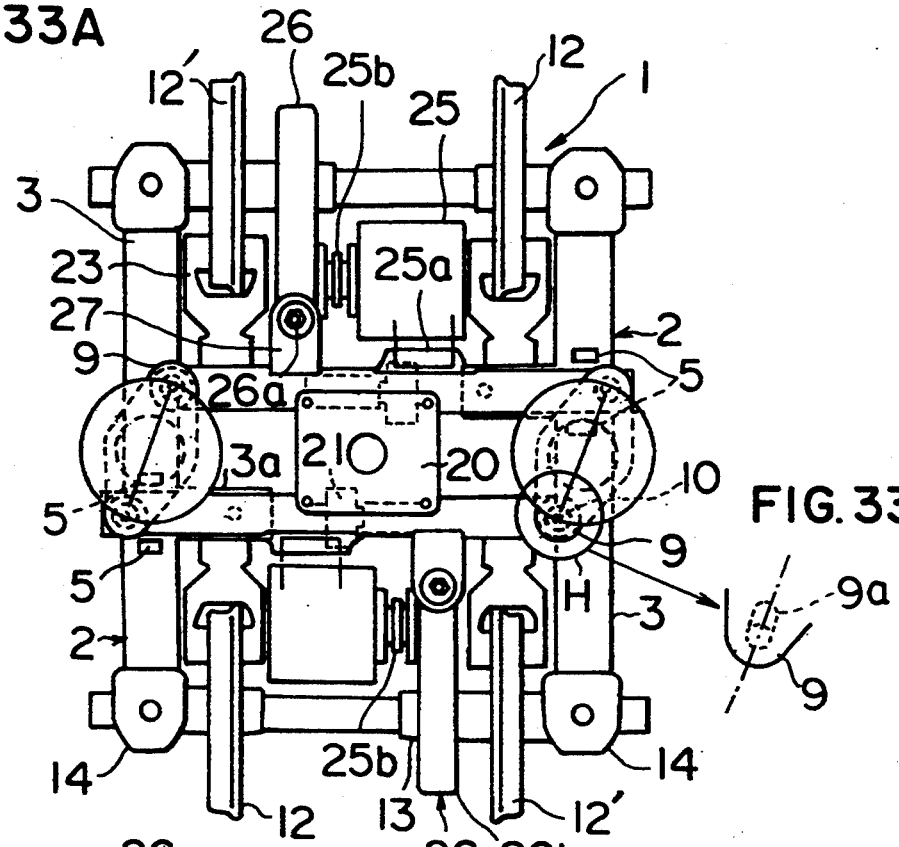
FIG. 33C
FIG. 33B
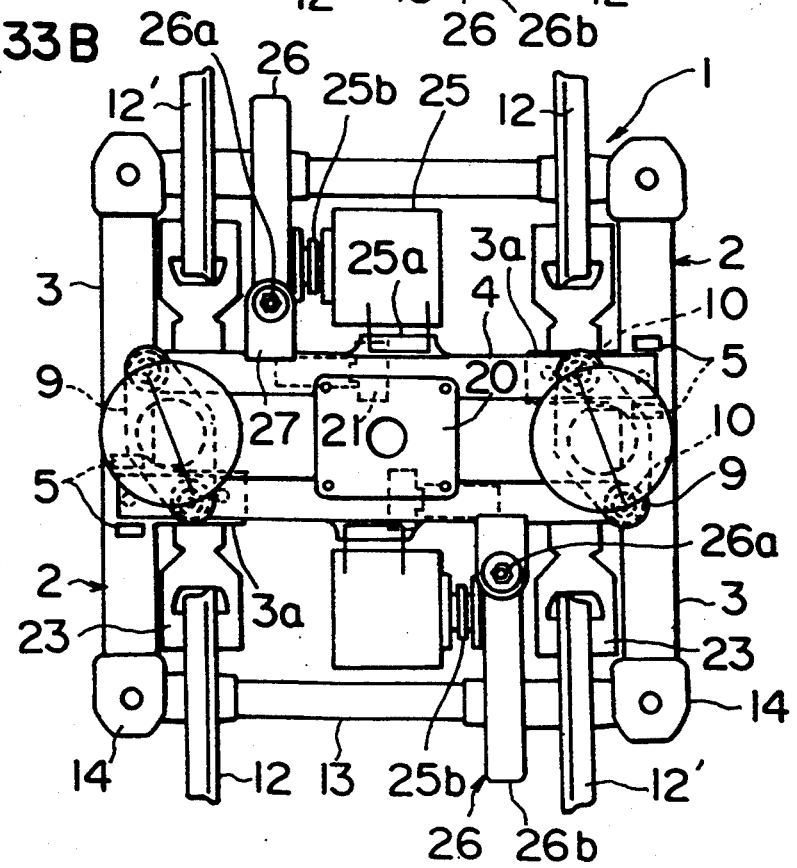

FIG. 41A
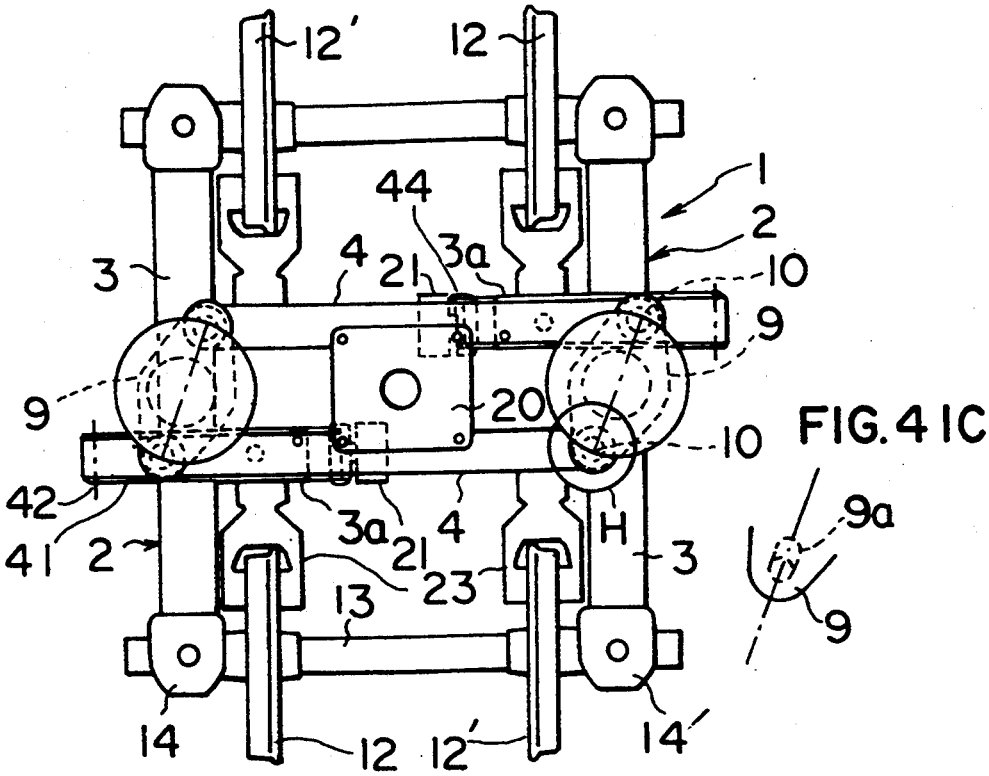
FIG. 41C
FIG. 41B
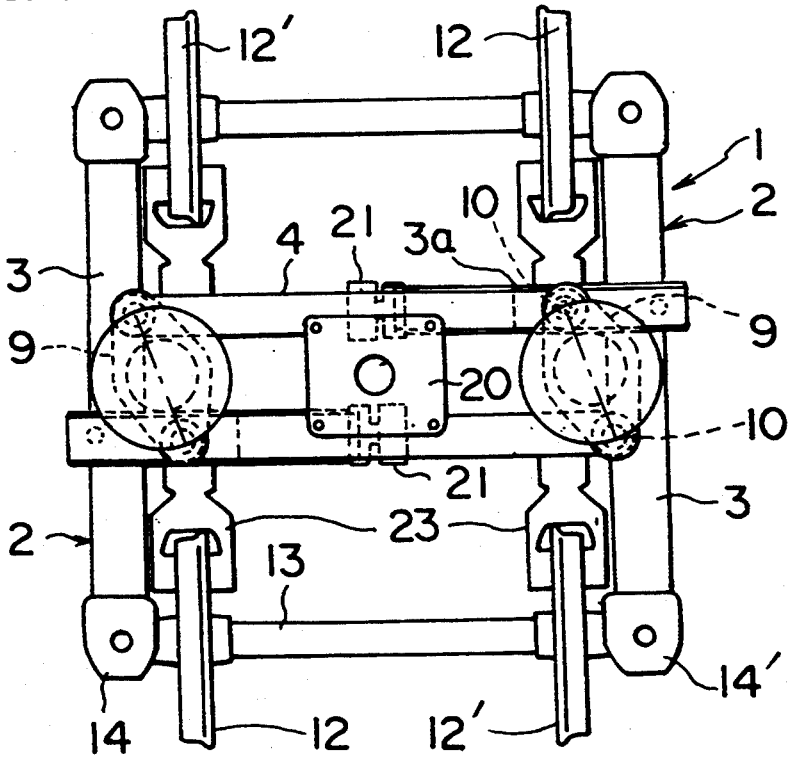

TRUCK WHEEL-SPACING CHANGING METHOD, AND VARIABLE WHEEL-SPACING TRUCK, AND GROUND FACILITY THEREFOR

FIELD OF THE INVENTION

The present invention relates to a method for changing, in accordance with a change of a track gauge, i.e. the spacing between a pair of rails of a railway or track, a wheel-spacing (referred to hereafter also as "wheel gauge"), i.e. the spacing between left and right wheels of a truck supporting a vehicle body thereon so that the vehicle constituted by the vehicle body and the changeable or variable wheel-spacing truck can run on rails of different track gauges. The invention also relates to a variable wheel-spacing truck, namely, a truck having wheels of variable wheel-spacing, and to a ground facility therefor.

RELATED ARTS

In a general vehicle, the wheel-spacing or gauge of the truck supporting the vehicle body is always maintained constant according to the constant track gauge, and it is impossible for a vehicle to run from a railway of one track gauge onto another railway of a different track gauge. For example, in the so-called "SHIN-KANSEN" line in Japan, a vehicle runs on a railway having a wider or standard track gauge, while in a so called "conventional line" in Japan, a vehicle runs only on a railway having a narrower track gauge.

Several prior art arrangements are described below:

1. When it is desired to come from one to another railway section where the track gauge is different, the track gauge in this section is reconstructed to be changed according to the wheel-spacing of the truck, thereby maintaining the wheel gauge, i.e. wheel-spacing, unchanged. This method is so called as "track gauge change".

2. There is a variable wheel-spacing truck which is used in the "TALGO TRAIN" in Spain. This truck comprises individually movable wheels, supported by wheel shafts, which are slidable to the left and right relative to the bogie frame, and lock pins or the like for determining the wheel-spacing, while the ground facility comprises truck-supporting rails and guide rails for guiding the wheels to predetermined positions. Changing the wheel-spacing is executed as follows: as a vehicle advances, the truck-supporting rails first contact with a part of the bogie frame and support the whole weight of the truck, whereby the wheels are released from loads and the lock pins are released. As a result, the wheels are allowed to slide to the left and right and are shifted to new positions by the help of the guide rails, and then, the lock pins are inserted for determining the positions of the wheels. Then, the truck is lowered from the truck-supporting rails, thereby completing the wheel-spacing changing operation.

3. Japanese Patent Laid-open (Unexamined Publication) No. 54-47221 discloses a bogie truck. In this bogie truck, a pair of left and right plate-like bogie frames are separated from each other in the left and right direction; wheels are rotatably mounted on front and rear portions of each bogie frame; there are provided under-spring bars supporting a vehicle body via springs, each bar being formed, on a lower surface thereof, with rack teeth extending in a rail-spacing direction, these rack teeth engaging with rack teeth formed at the middle portion of an upper surface of each of the bogie frame and extending in a rail-spacing direction. In order to change the truck wheel-spacing, the under-spring bars are first raised to be spaced from the rack teeth of the bogie frames by use of a belt conveyer, and then, as the vehicle body is advanced together with the under-spring bars and the wheels of the bogie frames, the wheel-spacing as well as the bogie frame-spacing are changed by a pair of rails having a gradually changing track gauge. When the truck is completely advanced onto a railway having a final target truck gauge, the under-spring bar raised by a belt conveyer is again lowered until the rack teeth of the under-spring bar engages with the rack teeth of the bogie frame, thereby determining the wheel-spacing.

The above-mentioned prior art arrangements however, involve various problems as follows:

1. In the first case of changing the track gauge, an enormous cost, labor and time are required for rebuilding or reconstructing the rail installation. Because of the unchanged truck wheel-spacing it is impossible for the vehicle to run on railways having different track gauges.

2. In the "TALGO TRAIN" during the wheel-spacing changing operation, the wheels are maintained apart from the rails. In consequence, self-propelled running of the truck is impossible, and accordingly, the truck wheel-spacing can not be changed unless some external power is given for driving the truck.

3. In case of Japanese Patent Laid-open No. 54-47221, since the vehicle body is raised above the bogie frames by use of a belt conveyer, the wheels are almost unloaded. As a result, contact or frictional force between the wheel and the rail required for self-propelled running of the truck is lost, thereby making it difficult to apply this method to a type of truck having a self-propelled wheel. Furthermore, there may be a risk of an overturning of the bogie frame, not only when the vehicle body is raised above the bogie frame, but also during the running of the vehicle. In addition, it is difficult to maintain the advancing speed of the bogie frame equal to that of the under-spring bar during a wheel-spacing changing operation.

SUMMARY OF THE INVENTION

In view of the above-mentioned disadvantages of the prior art, the object of the present invention is to provide a tuck wheel-spacing changing method, a variable wheel-spacing truck and a ground facility therefor, in which the truck may be a self-propelled truck, i.e. a tracted truck, in which the running stability of the vehicle is not inferior to that of a conventional truck of the fixed wheel-spacing, in which the ground facility includes no moving parts; and in which the wheel-spacing changing mechanism can be easily maintenanced.

For achieving the above objects of the present invention, in a truck wheel-spacing changing method according to the present invention, a) while the truck to be moved from one railway of a track gauge onto another railway of a different track gauge is passed through a junction railway connecting the above two railways, b) the truck is provided with a pair of bogie frames movable relative to each other and connected with each other by a releasable locking means, and at least one of a pair of wheels of the truck is adapted to freely slide on a wheel shaft in the axial direction thereof, c) when the truck moves from the one railway onto the junction railway, running path means raise auxiliary wheels of a locking means to release a locking connection of bogie frames and maintain the same in a released condition, d) the truck is then advanced along the junction railway where the track gauge is gradually changed, whereby a pair of guide rails or a pair of rails of the above-mentioned railway push the wheels of the truck, e) the bogie frames each supporting the wheel connected thereto are transversely moved relative to each other by the pushing forces from the rails, f) after a predetermined movement of the track frames or wheels is completed, the running path means engaging with the auxiliary wheels of the locking means allow the auxiliary wheels to be lowered thereby locking the bogie frames by the locking means and maintaining the same at a locked condition, and g) then, the truck is moved out of the junction railway into said another railway, thereby completing a truck wheel-spacing changing operation.

According to a truck wheel-spacing changing method having the above-mentioned features of the present invention, when a truck moves, for example, from a narrower track gauge railway into a wider track gauge railway, a transverse beam of each track frame constituted by a transom and a side beam, extending perpendicularly to a side beam and supporting a part of the vehicle weight is upwardly pushed by the associated auxiliary wheel just before the truck advances into the intermediate railway, whereby the locking means restricting the positional relation between a tip portion of the transom of one bogie frame and the side beam of the other bogie frame is released and maintained in a released condition. This condition is continued until the truck advances completely onto the wider track gauge railway after passing through the junction railway. During the time of the transitional motion of the truck, at least one of the wheels which is slidable relative to the wheel shaft is transversely outwardly slided according to the gradual change of the track gauge, and at the same time, one of the side beam supporting one side wheel(s) is outwardly slided relative to the other side beam. Finally, the truck wheel-spacing is widened until the wheel-spacing coincides with the wider track gauge, and the spacing between the pair of side beams each constituting a part of the bogie frame is also widened in accordance with the widening of the truck wheel-spacing. In this process, the vehicle weight raised upwardly by the auxiliary wheel is loaded again on the tip portions of the transverse beams, and the transverse positional relation between the side beams and the transverse beams is again fixed and maintained at a fixed condition by means of the locking means. As a result, the spacing between the bogie frames and the truck wheel-spacing can be maintained at a constant value, and the truck is assured to run on a new wider track gauge railway with sufficient stability. Furthermore, in case the truck moves from a wider track gauge railway to a narrower track gauge railway, the wheel-spacing can be suitably changed by a method similar to the above-mentioned one.

In consequence, in a wheel-spacing changing method according to the present invention, the locking means for fixing the truck wheel-spacing can be released by pushing upwards the auxiliary wheels mounted on the bogie frames by utilizing a part of the driving or advancing force of the truck, without any external power for the unlocking. The sliding of the wheel(s) to a new position is carried out also by utilizing a part of the driving (advancing) force of the truck, wherein the track rails and the guide rails cooperate to push the wheel(s), and the wheel-spacing is changed also without any special power. The locking farce for fixing the wheel-spacing is produced when the auxiliary wheels mounted on the truck are separated from the running path means and the vehicle weight is again loaded on the transverse beams of the truck. When the truck passes through the variable track gauge railway, i.e. junction railway, it is possible to use a usual vehicle driving motor, and the truck can proceed by utilizing frictional force due to the vehicle weight.

In the above arrangement, one of the wheels may be prevented from moving relative to the wheel shaft in the axial direction of the shaft while permitting the other wheel to slide relative to the wheel shaft in the axial direction, or both of the wheels may freely slide relative to the wheel shaft in the axial direction.

For executing the above-mentioned method, a variable wheel-spacing truck, namely, a truck with variable wheel-spacing according to the present invention comprises A) a pair of (left and right) T-shaped bogie frames each having a side beam and a transverse beam, an end portion of the transom of one of the T-shaped bogie frames overlapping with the side beam of the other one of the bogie frames, B) a pair of (left and right) vehicle body-supporting means each including an elastic member and mounted on an associated one of the bogie frames, C) locking means for fixing the positional relation between the (left and right) bogie frames at a plurality of positions in a left and right direction, the locking means including auxiliary wheels movable in a vertical direction for effecting the locking and unlocking, D) a pair of (left and right) wheels, at least one of these wheels being able to slide relative to the wheel shaft in the axial direction thereof, and E) axle boxes each supporting an associated (left or right) wheel and an associated bogie frame, and supporting means for supporting the axle boxes.

For executing the above-mentioned method, a ground facility according to the present invention comprises a) a railway having a narrower track gauge, a railway having a wider track gauge and a junction railway including a middle portion where the track gauge gradually changes and end portions where the track gauge is constant, and b) running path means for the auxiliary wheels extending within the intermediate railway, the running path means being arranged, in plan view, so that a predetermined positional relation to the railway rails of the changing track gauge is maintained, and being shaped, in elevational view, so that a top surface of the path means is higher than the top surfaces of the rails of the junction railway at a region beyond the whole length of the middle portion, while both end portions thereof are continuously inclined downwards to respective ends.

In a variable wheel-spacing truck having the above-mentioned arrangement according to the present invention, when the wheel-spacing is changed in accordance with the change of the track gauge in the above-mentioned ground facility, one and another transverse beams of one and another "T"-shaped bogie frames are respectively moved relative to the opposite side beams of the opposite bogie frames while maintaining a parallel relation therebetween at a certain spacing therebetween in the vehicle proceeding direction by the help of respective link members. The two transversel beams are moved closer to or apart from each other while maintaing their parallel relationship. As a result, the above-mentioned truck wheel-spacing changing method can be surely executed.

In the above-mentioned variable wheel-spacing truck, one of the left and right wheels may be fixed to the wheel shaft so as to prevent the wheel from moving relative to the wheel shaft in the axial direction of the shaft, whereby the wheel shaft portion on the fixed wheel side is engaged with and supported by the bogie frame through the axle box and the supporting means therefor, or both of the left and right wheels may be allowed to slide relative to the wheel shaft in the axial direction of the shaft.

Further, in the above-mentioned variable wheel-spacing truck, F) the above-mentioned locking means may include the auxiliary wheels between the left and right wheels to serve as a force-acting point upon separating the bogie frames from each other in a vertical direction for releasing the locking condition, or upon engaging for locking.

In this case, upon a wheel-spacing changing operation, when the transom tip portion of one bogie frame is raised through the auxiliary wheel relative to the transverse beam of the other bogie frame, the restraining condition, by the locking means, determining the relative position of both bogie frames is released. As a result, at least one of the wheels which is slidable relative to the wheel shaft slides in accordance with the change of the truck gauge together with the transom of the bogie frame mounting thereon this at least one wheel. At this instant, a part of the vehicle weight acting on each link member is also supported by the auxiliary wheel: this means that the part of the vehicle weight is supported at three points, namely, by the front and rear wheels of each bogie frame and the auxiliary wheel disposed therebetween. As a result, the load acting on each wheel is decreased, and accordingly, it becomes easy for the slidable wheel to slide. In consequence, since, even in an operation of changing the wheel-spacing in accordance of the change of the track gauge by the help of a ground facility, driving means for each wheel can be always connected to be supported by a corresponding bogie frame, and the conventional driving device can be still utilized.

Still further, G) the above-mentioned locking means may be so constructed that one bogie frame on one side of the vehicle is raised or lowered relative to the other bogie frame by use of the auxiliary wheels serving as a force-acting point and disposed transversely outside of the running wheel, thereby effecting unlocking or locking by the locking means.

In this case, although the wheel is slided in a manner substantially similarly to the wheel of a truck having the above-mentioned arrangement F, the position where the raising force of the auxiliary wheel applied to the transom is shifted to near the tip end of the transverse beam. As a result, the raising of the transom becomes more smooth or easy in comparison with in the case of arrangement F.

Still further, in the above-mentioned variable wheel-spacing truck, H) the above-mentioned locking means may include a locking pin which releases the two bogie frames from each other or engages the two bogie frames pivotally with each other by raising or lowering the auxiliary wheel, respectively. In this case, a lever member is inclined around a pivot point by the auxiliary wheel, thereby raising an end portion of the link member together with the locking pin as releasing the connection between the transversal beam of one bogie frame and the side beam of another bogie frame.

Still further, in the above-mentioned variable wheel-spacing truck, I) the transversely slidable wheel may be adapted to rotate around the wheel shaft. In this case, since the left and right wheels can rotate independently relative to each other, the running stability along a straight railway is excellent.

Alternatively, J) the slidable wheel may be adapted to be prevented from rotating relative to the wheel shaft. In this case, since both of the left and right wheels are nonrotatably fixed relative to the wheel shaft, the behavior of these wheels is the same as conventional wheels as far as the rotating feature is concerned.

A ground facility according to the present invention having the above-mentioned arrangement comprises rails and running path means, but no moving parts. The rails serve to press the wheels when a vehicle moves from a wider track gauge railway onto a narrower track gauge railway.

The above-mentioned ground facility may further comprise c) a pair of inside guide rails which are arranged to extend beyond the whole length of the running path means and within the above-mentioned junction railway inside of the pair of rails in plan view, while maintaining a predetermined dimensional relation relative to the railway tracks (rails) with their heights maintained higher than the top surface of the rails. In this case, the ground facility is composed of rails, running path means and inside guide rails, but includes no moving parts. The inside guide rails serve to press the wheels when a vehicle moves from a wider track gauge railway onto a narrower track gauge railway.

In the ground facility, d) the above-mentioned ground facility may comprise a pair of outside guide rails which are arranged to extend beyond the whole length of the running path means and within the above-mentioned junction railway section at outside of the pair of rails in plan view, while maintaining a predetermined dimensional relation relative to the rails or tracks, with their heights maintained higher than the top surface of the rails. In this case, the ground facility is composed of rails, running path means and outside guide rails, but includes no moving parts. The outside guide rails serve to press the wheels when a vehicle moves from a wider track gauge railway onto a narrower track gauge railway. Since the wheel pressing force is relatively greater in this ground facility in comparison with one not having the arrangement d), the length of the junction railway section of this ground facility can be shortened in comparison with the ground facility not having arrangement d).

Further, e) the above-mentioned ground facility may comprise a pair of inside guide rails which are arranged to extend beyond the whole length of the running path means and within the above-mentioned junction railway section at positions inside of the pair of rails in plan view, while maintaining a predetermined dimensional relation relative to the tracks or rails, with their heights maintained higher than the top surface of the rails, and a pair of outside guide rails which extend beyond the whole length of the running path means and within the above-mentioned junction railway section outside of the pair of rails in plan view, while maintaining a predetermined dimensional relation relative to the tracks or rails, with their heights made higher than the top surface of the rails. In this case, the ground facility is composed of railway rails, running path means, inside guide rails and outside guide rails, but includes no moving parts. It is possible for a vehicle to move from a railway having a narrower track gauge onto a railway having a wider track gauge and also to move from a railway having a wider truck gauge onto a railway having a narrower truck gauge. When a vehicle moves from a narrower track gauge railway onto a wider track gauge railway, the inside guide rails serve to press the wheels, while when a vehicle moves from a wider track gauge railway onto a narrower track gauge railway, the outside guide rails serve to press the wheels.

Furthermore, in the ground facility, the running path means may be located g) inside of the pair of rails or h) outside of the same, the former arrangement corresponding to truck having a structural feature F or H where the auxiliary wheel is disposed inside of the rail, while the latter arrangement corresponds to a truck having structural feature G where the auxiliary wheel is disposed outside of the rail.

BRIEF DESCRIPTION OF DRAWINGS

FIGS. 1A to 1C show a sequence of changing a wheel-spacing or track gauge, wherein FIG. 1A is a side view of a self-propelled truck according to a first embodiment of a variable wheel-spacing truck of a first type of the present invention and a ground facility with running paths disposed outside of rails; FIG. 1B is a plan view of the ground facility shown in FIG. 1A; and FIG. 1C is a series of elevational views of the truck shown in FIG. 1A when standing at locations A to G upon a truck wheel-spacing changing operation.

FIGS. 2A and 2B show an embodiment of a ground facility according to the present invention, wherein FIG. 2A is a side view showing running paths arranged outside of both rails, with the facility having inside guide rails and outside guide rails; and FIG. 2B is a plan view of the ground facility shown in FIG. 2A.

FIGS. 3A and 3B show another embodiment of the ground facility, wherein FIG. 3A is a side view showing running paths arranged outside of both rails, and inside guide rails; and FIG. 3B is a plan view of the ground facility shown in FIG. 3A.

FIGS. 4A to 4C show a variable wheel-spacing truck according to the first embodiment, wherein FIG. 4A is a plan view for the case of a narrower track gauge railway and FIG. 4B is a plan view in case of a wider track gauge railway; and FIG. 4C is an enlarged view of a part H of the truck of FIG. 4A.

FIGS. 8A to 8C show a variable wheel-spacing truck according to the first embodiment as applied to a tracted truck wherein FIGS. 8A and 8B are plan views for the case of a narrower track gauge railway and for the case of a wider track gauge railway, respectively; and FIG. 8C is an enlarged view of a part H of the truck of FIG. 8A.

FIGS. 11A to 11C show a sequence of changing a truck wheel-spacing or track gauge, wherein FIG. 11A is a side view of a self-propelled truck according to a second embodiment of a variable wheel-spacing truck of the present invention and a ground facility with running paths disposed inside of rails; FIG. 11B is a plan view of the ground facility shown in FIG. 11A; and FIG. 11C is a series of elevational views of the truck shown in FIG. 11A when standing at locations A to G during a truck wheel-spacing changing operation.

FIGS. 12A and 12B show an embodiment of a ground facility, wherein FIG. 12A is a side view showing running paths arranged inside of both rails, inside guide rails and outside guide rails; and FIG. 12B is a plan view of the ground facility shown in FIG. 12A.

FIGS. 13A and 13B show another embodiment of the ground facility, wherein FIG. 13A is a side view showing running paths arranged inside of both rails, and inside guide rail, but no outside guide rail; and FIG. 13B is a plan view of the ground facility shown in FIG. 13A.

FIGS. 14A to 14C show a variable wheel-spacing truck according to the second embodiment, wherein FIG. 14A is a plan view for a narrower track gauge and FIG. 14B is a plan view for a wider track gauge; and FIG. 14C is an enlarged view of part H of the truck shown in FIG. 14A.

FIGS. 17A to 17C show a variable wheel-spacing truck according to the second embodiment as applied to a tracted truck, wherein FIGS. 17A and 17B are plan views for a narrower track gauge and for a wider track gauge, respectively; and FIG. 17C is an enlarged view of part H of the truck shown in FIG. 17A.

FIGS. 18A to 18C show a sequence of changing a truck wheel-spacing or track gauge, wherein FIG. 18A is a side view of a self-propelled truck according to the third embodiment of a variable wheel-spacing truck of the present invention and a ground facility including running paths disposed inside of both rails; FIG. 18B is a plan view of the ground facility shown in FIG. 18A; and FIG. 18C is a series of elevational views of the truck shown in FIG. 18A when standing at locations A to G during a truck wheel-spacing changing operation.

FIGS. 19A to 19C show a variable wheel-spacing truck according to the third embodiment, wherein FIG. 19A is a plan view for a narrower track gauge and FIG. 19B is a plan view for a wider track gauge; and FIG. 19C is an enlarged view of part H of the truck shown in FIG. 19A.

Figure 19A:
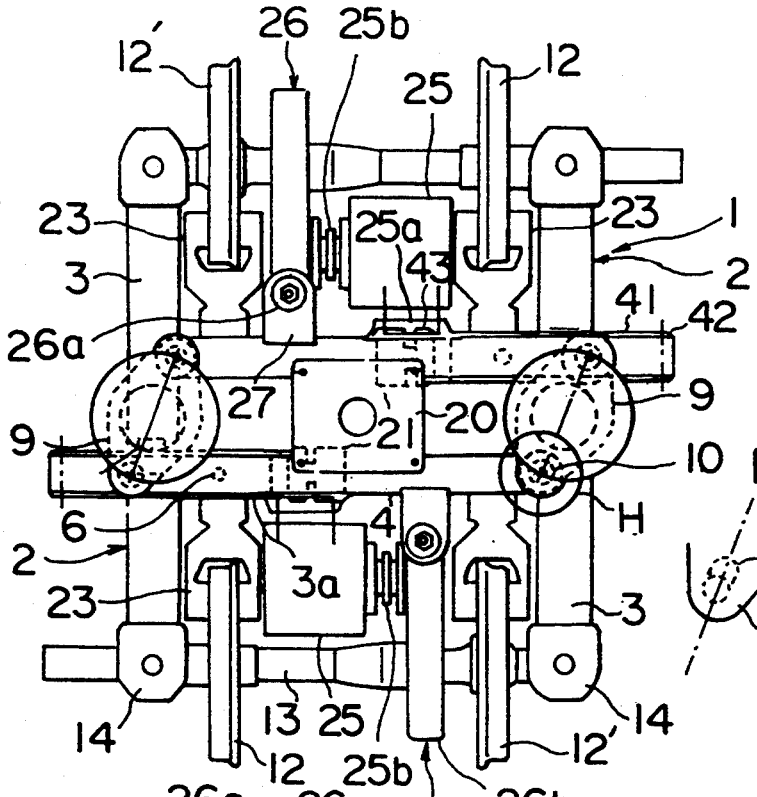
Figure 19C:
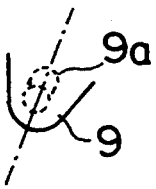
Figure 19B:
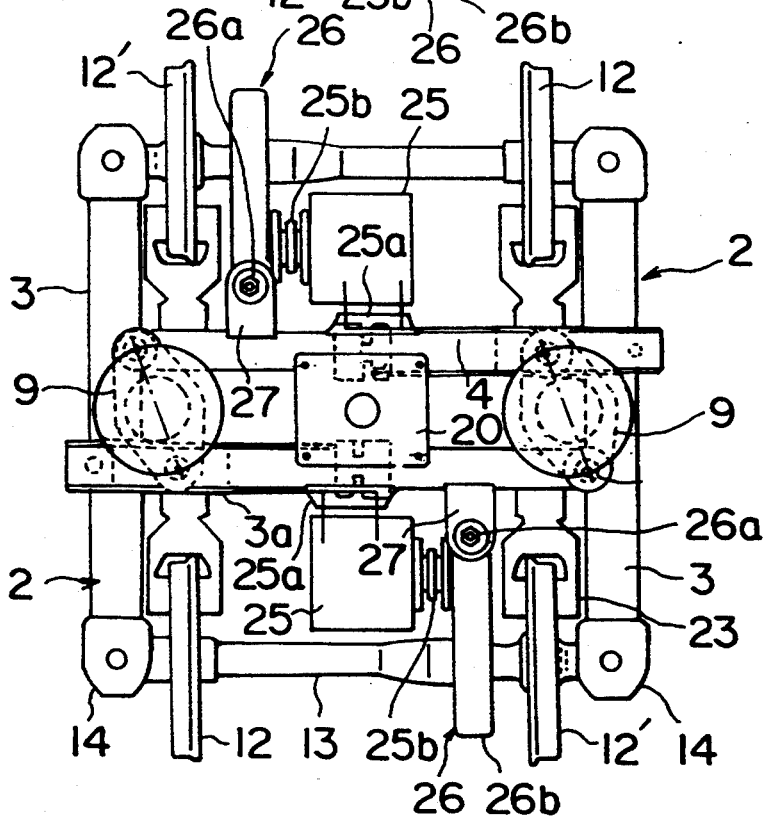
Figure 21:
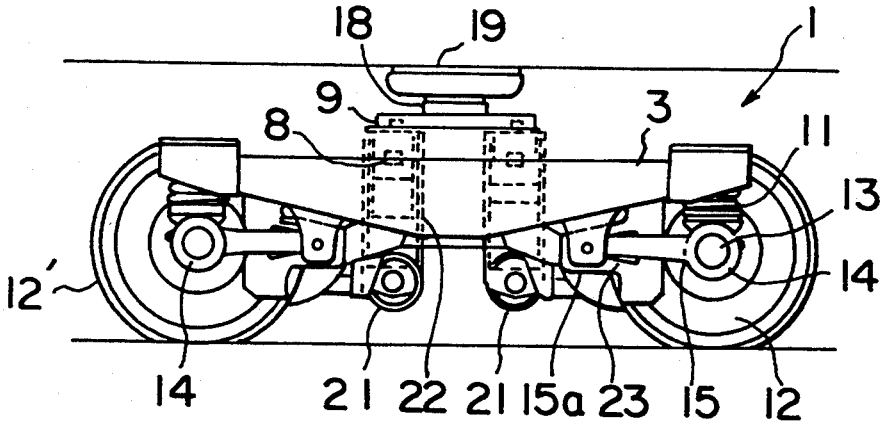

FIG. 21 is a side view of the variable wheel-spacing truck shown in FIGS. 19A to 19C when an auxiliary wheel is not acting.

Figure 22:
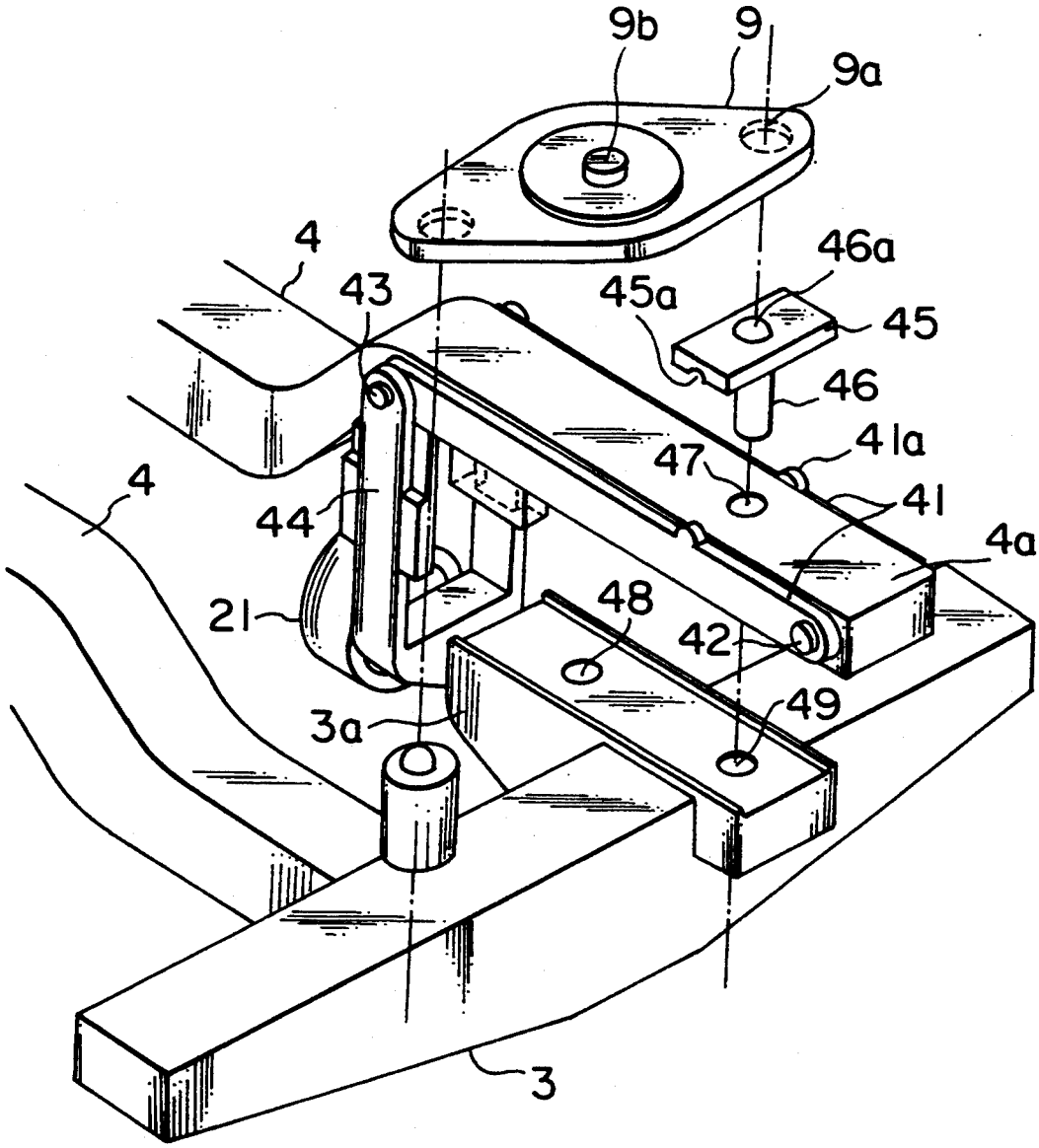

FIG. 22 is an enlarged perspective view showing a main part of a locking and unlocking means of a lever type in the variable wheel-spacing truck shown in FIGS. 19A to 19C.

Figure 23A:
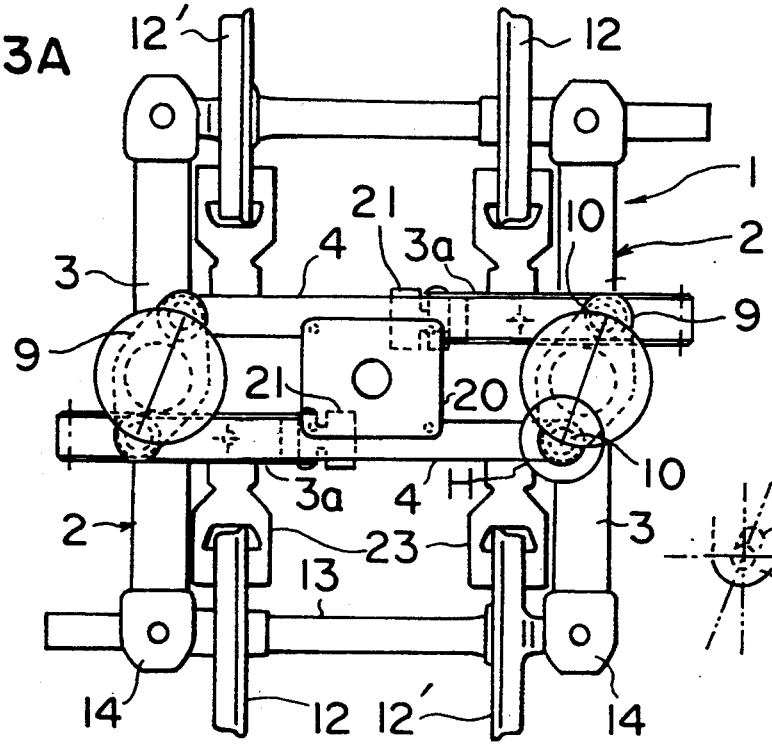
Figure 23C:
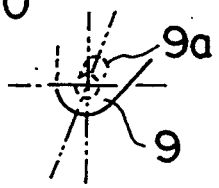
Figure 23B:
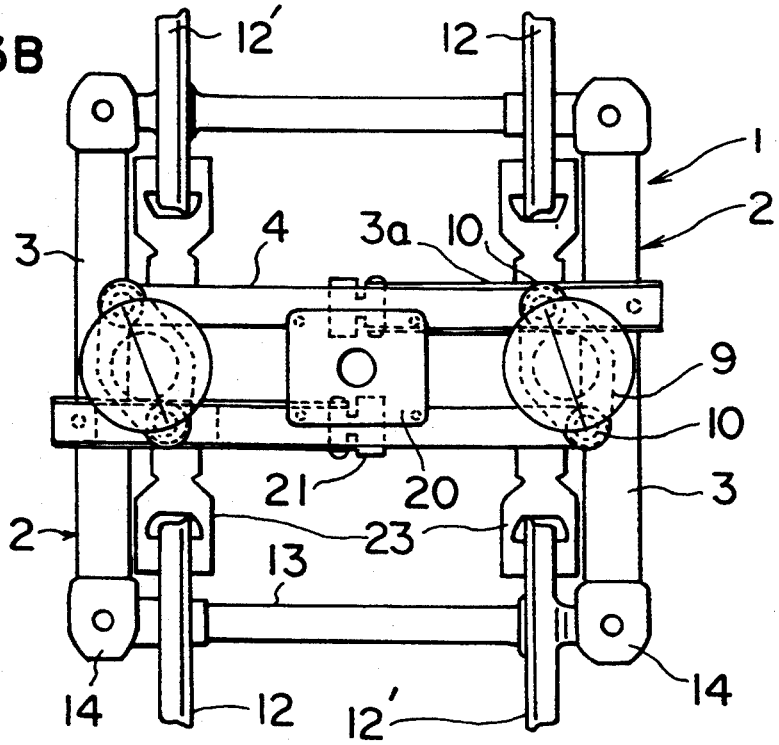

FIGS. 23A to 23C show a variable wheel-spacing truck according to the third embodiment as applied to a tracted truck, wherein FIGS. 23A and 23B are plan views for the case of a narrower track gauge and for the case of a wider track gauge, respectively; and FIG. 23C is an enlarged view of part H of the truck shown in FIG. 23A.

Figure 24:
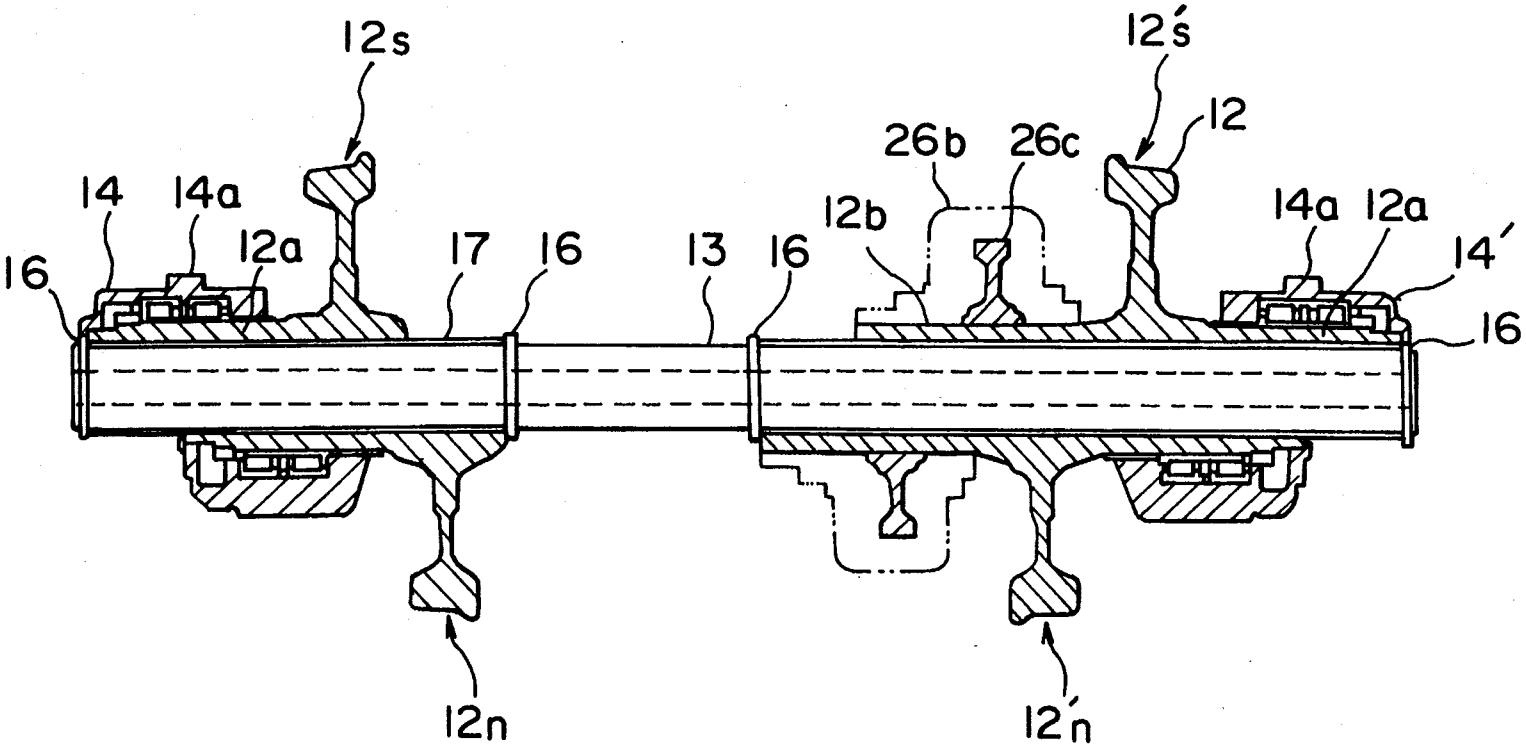

FIG. 24 is an enlarged sectional view of a wheel shaft of a self-propelled truck according to an embodiment of the second type of the present invention, wherein the upper potion of the figure shows the shaft for the case of a wider wheel-spacing or track gauge, while the lower portion of the figure shows the shaft for the case of a narrower wheel-spacing or track gauge.

Figure 25:
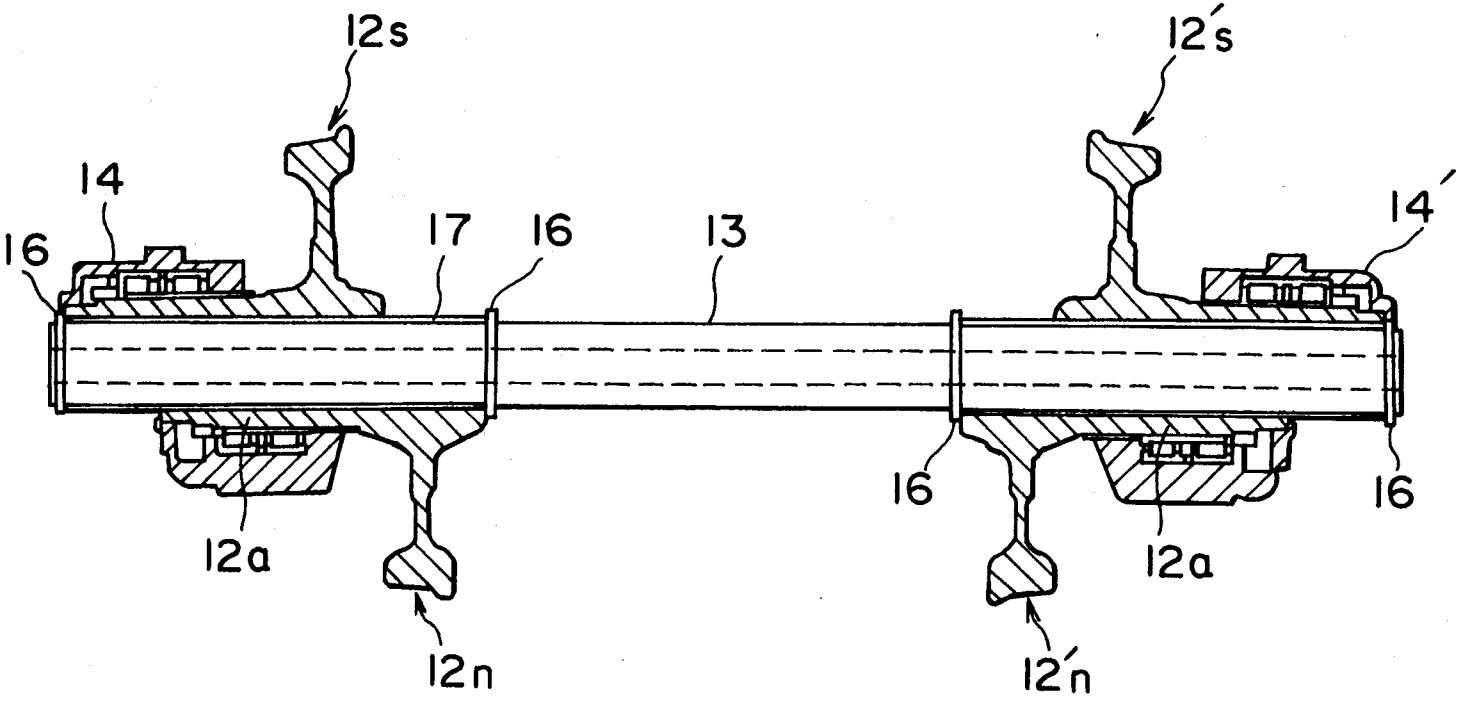

FIG. 25 is an enlarged sectional view of a wheel shaft of a variable wheel-spacing truck of a tracted type according to an embodiment of the second type of the present invention, wherein the upper potion of the figure shows the shaft for a wider wheel-spacing or track gauge and the lower half portion of the figure shows the shaft for a narrower wheel-spacing or track gauge.

Figures 1A, 1B, 1C:
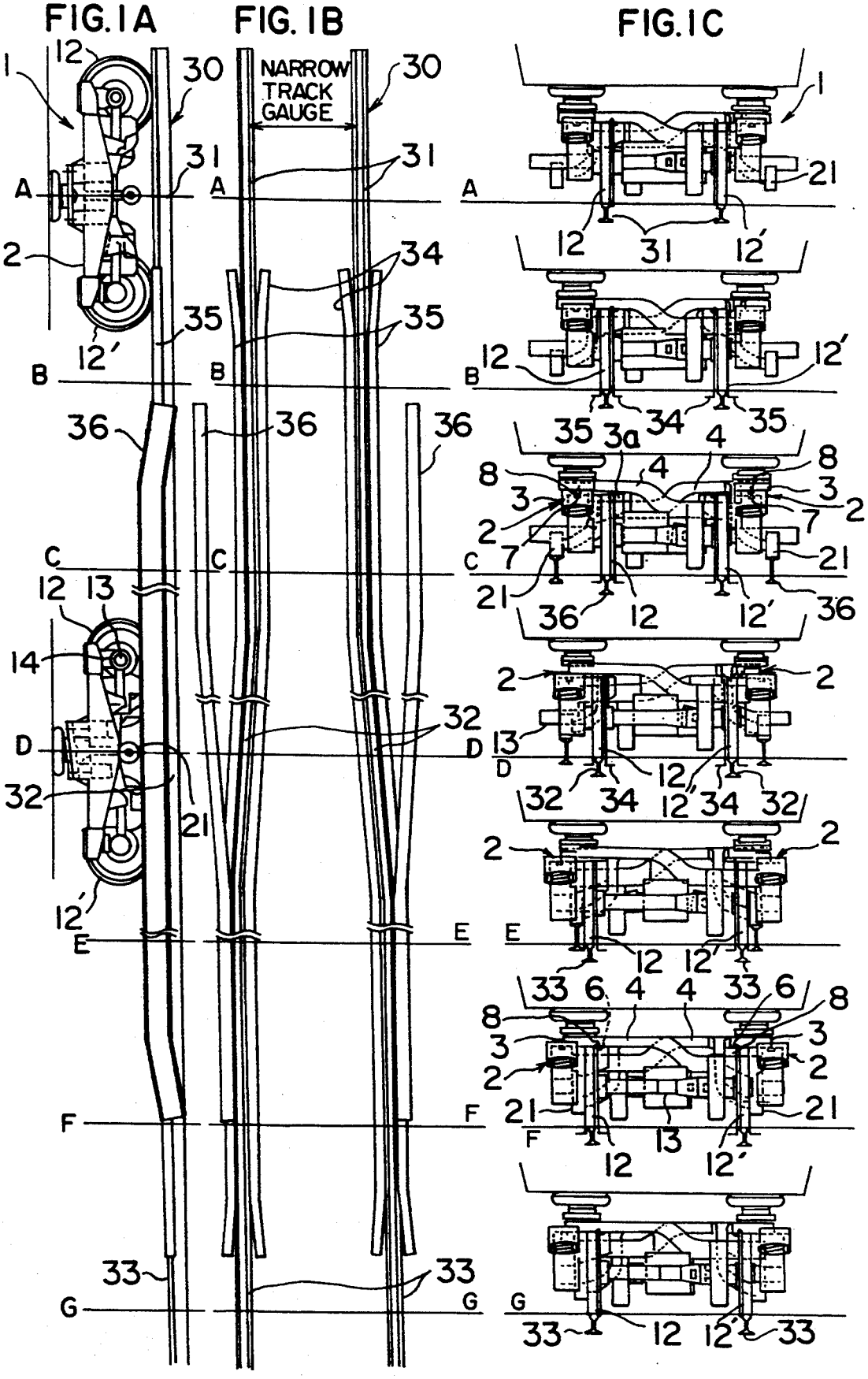
Figures 26A, 26B, 26C:
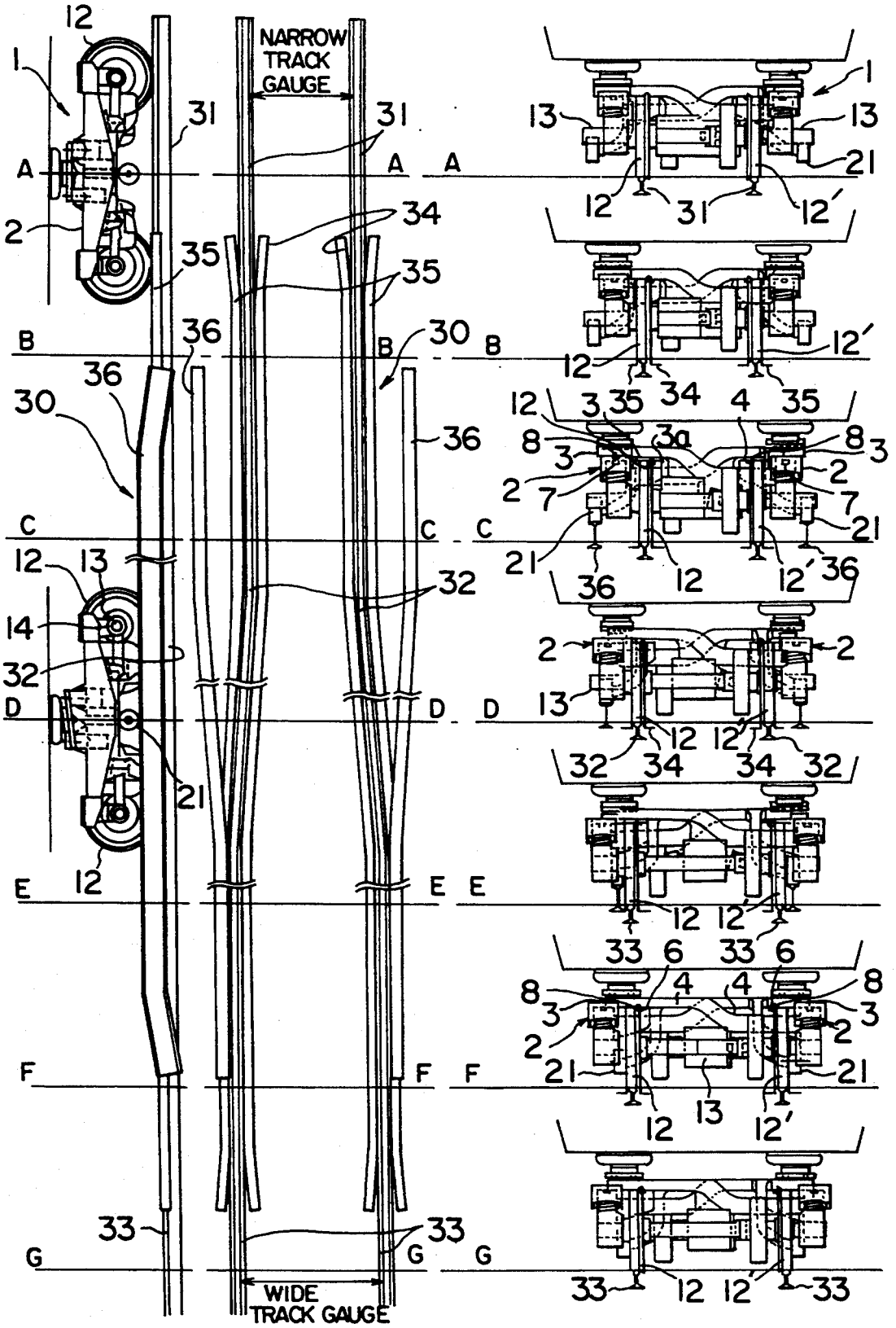

FIGS. 26A to 26C show a sequence of changing a truck wheel-spacing or track gauge similarly to FIGS. 1A to 1C, wherein FIG. 26A is a side view of a self-propelled truck of the second type according to a fourth embodiment of a variable wheel-spacing truck of the present invention and a ground facility including running paths disposed outside of both rails; FIG. 26B is a plan view of the ground facility shown in FIG. 26A; and FIG. 26C is a series of elevational views of the truck shown in FIG. 26A when standing at locations A to G during a truck wheel gauge changing operation.

Figure 4A:
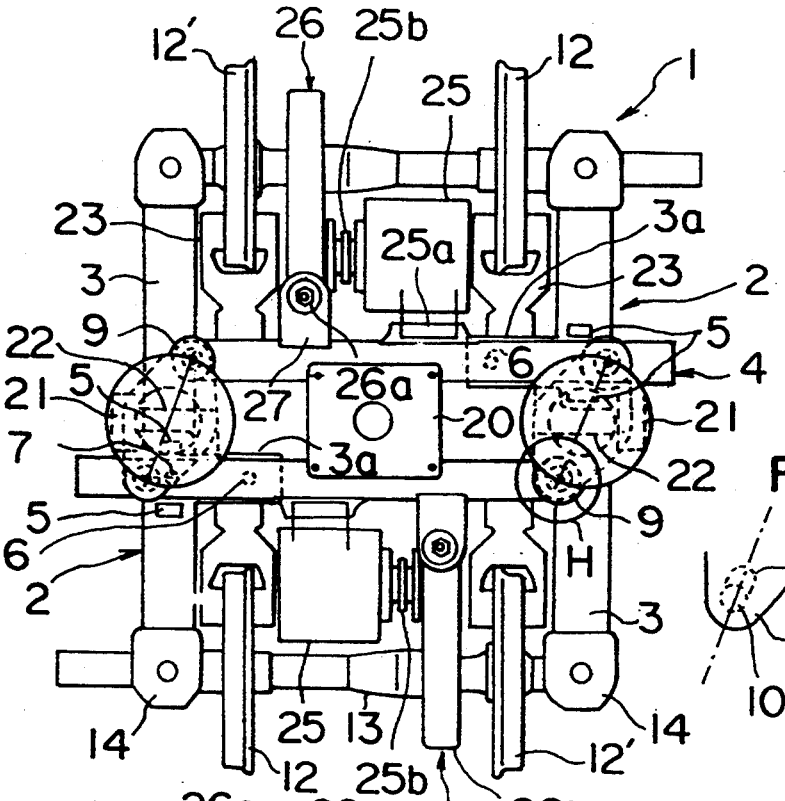
Figure 4C:
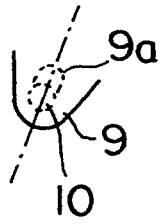
Figure 4B:
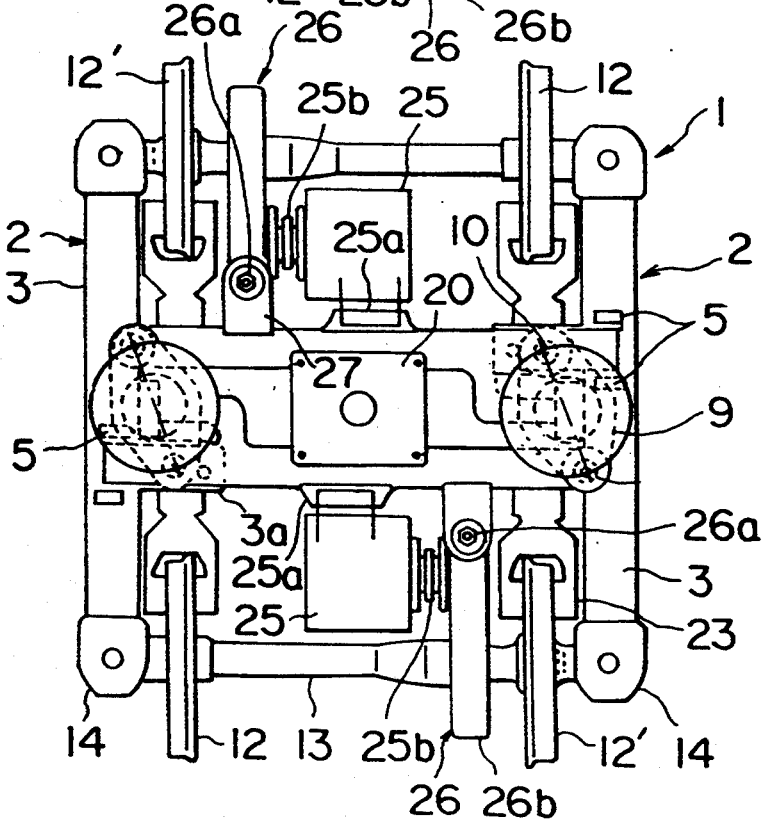
Figure 27A:
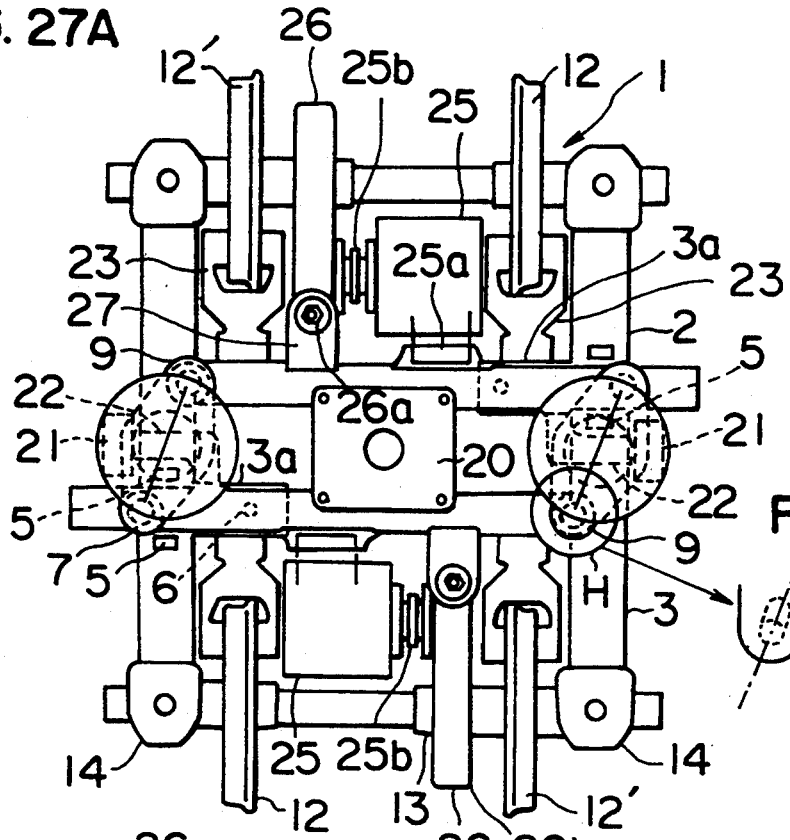
Figure 27C:
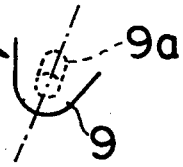
Figure 27B:
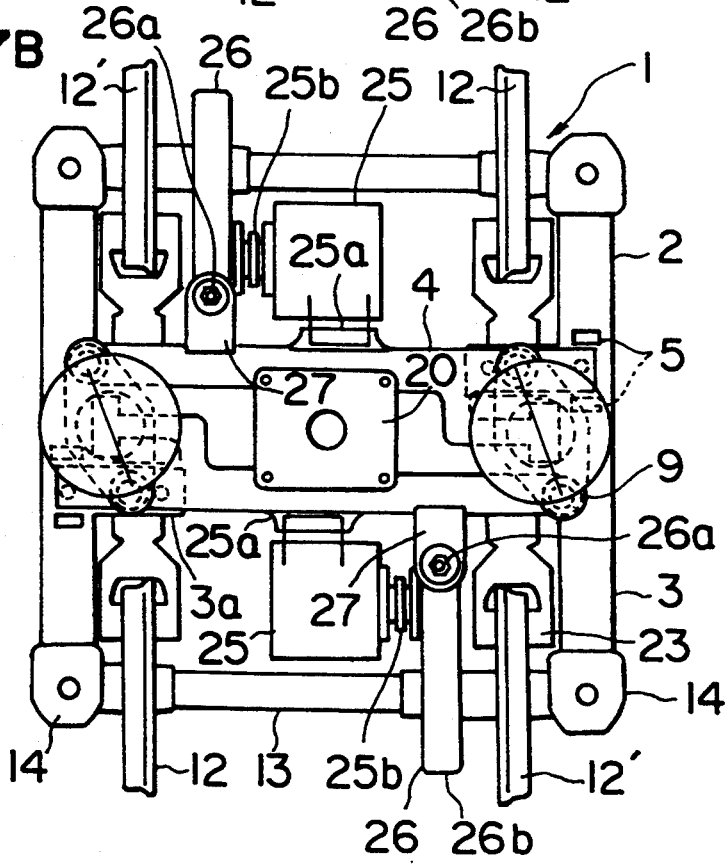

FIGS. 27A to 27C show a variable wheel-spacing truck according to the fourth embodiment similar to FIGS. 4A to 4C, wherein FIG. 27A is a plan view for in a narrower track gauge and FIG. 27B is a plan view in for a wider track gauge; and FIG. 27C is an enlarged view of part H of the truck shown in FIG. 27A.

Figure 5A:
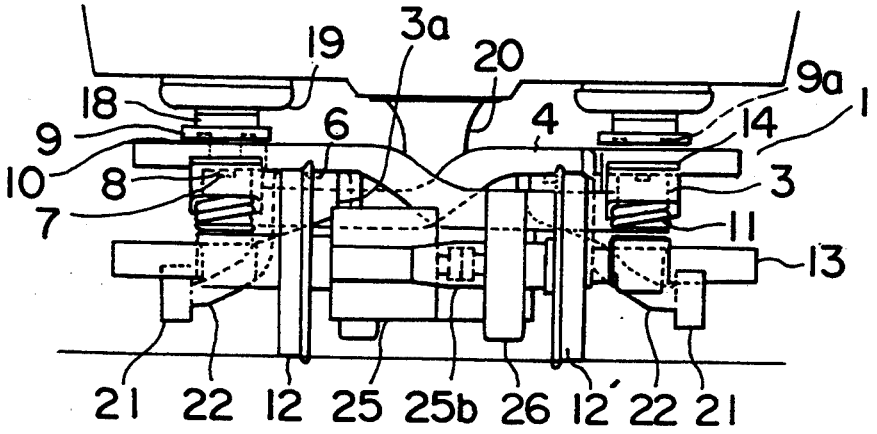
FIGS. 5A and 5B are elevational views of the truck shown in FIGS. 4 for the case of the narrower track gauge railway and for the case of the wider track gauge railway, respectively.
Figure 5B:
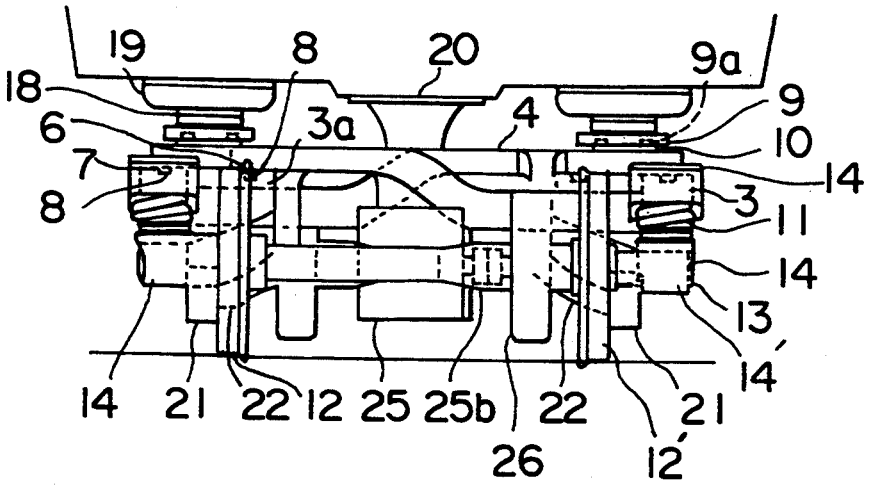
Figure 28A:
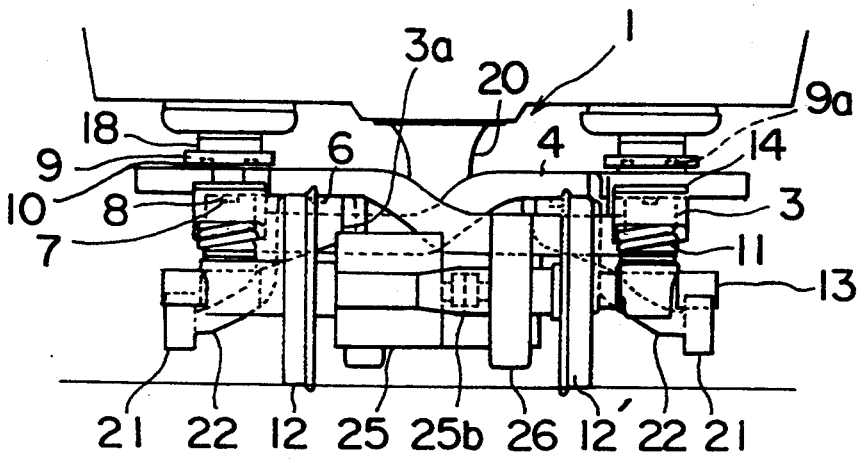
Figure 28B:
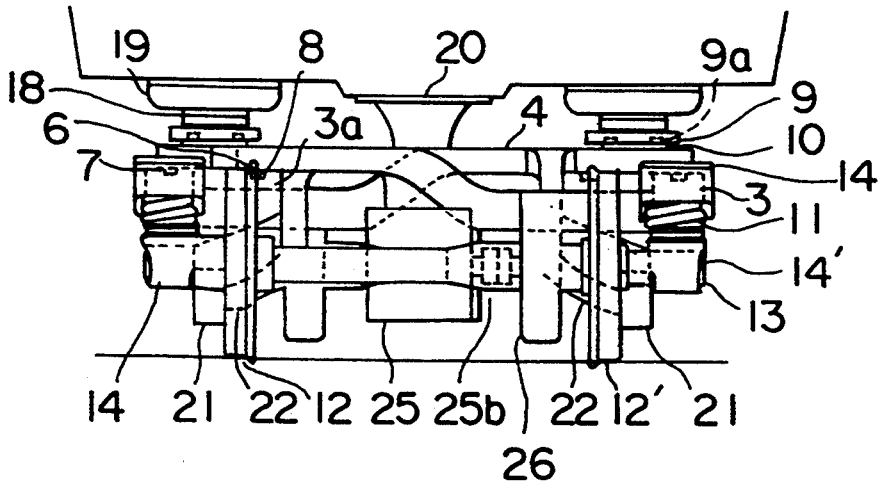

FIGS. 28A and 28B, similar to FIGS. 5A and 5B, are elevational views of the truck shown in FIGS. 27A to 27C for a narrower track gauge and for a wider track gauge, respectively.

Figure 6:
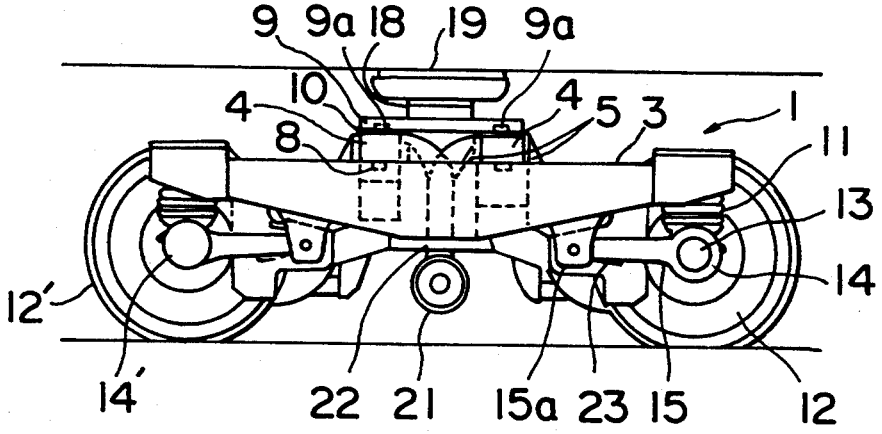
FIG. 6 is a side view of the truck shown in FIGS. 4A add 4B when an auxiliary wheel is not acting.
Figure 29:
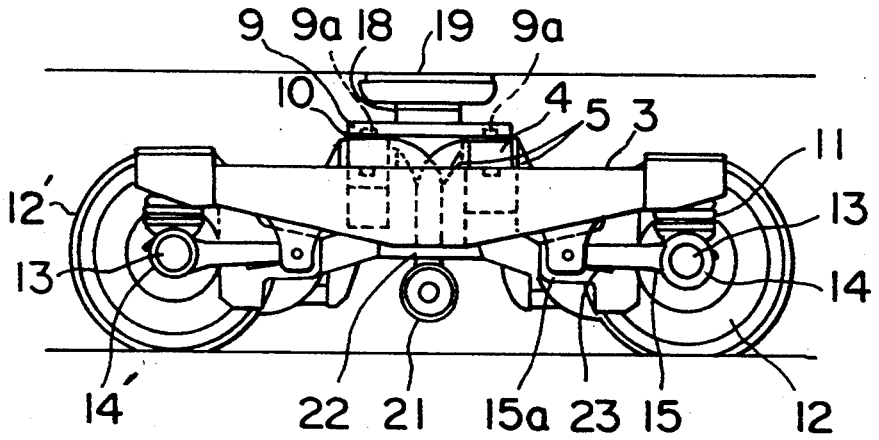

FIG. 29 is a side view, similar to FIG. 6, of a variable wheel-spacing truck shown in FIGS. 27A to 27C when an auxiliary wheel is not acting.

Figure 7A:
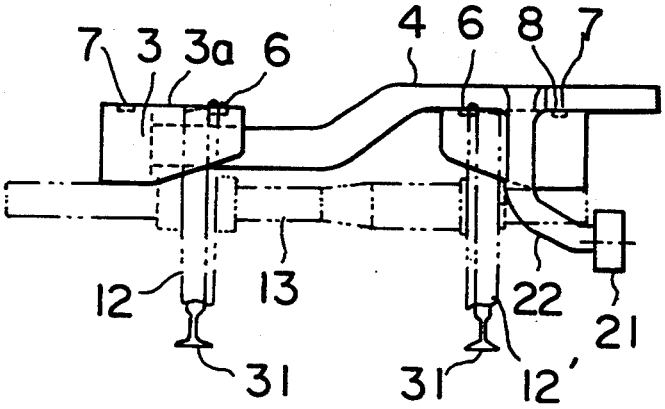
FIG. 7A, 7B and 7C are elevational views of side beams, an auxiliary wheel, a transom, and a wheel shaft of the truck shown in FIG. 1B at positions A and B, at positions C add D, and at positions F and G, respectively.
Figure 7B:
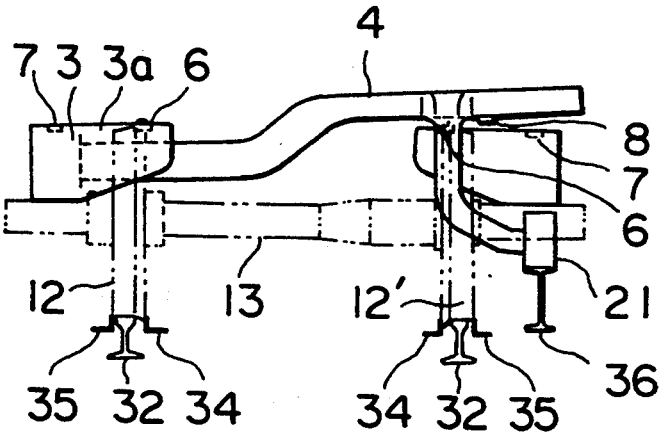
Figure 7C:
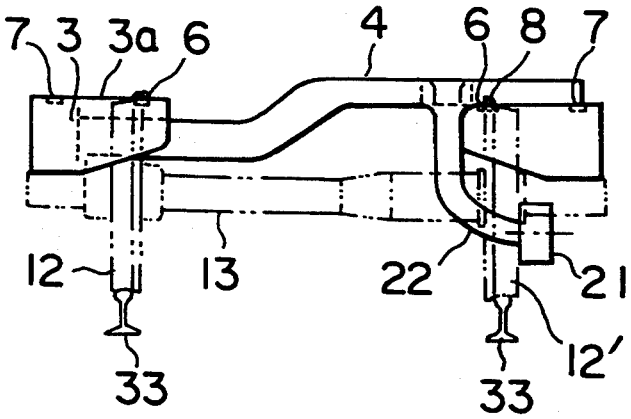
Figure 30A:
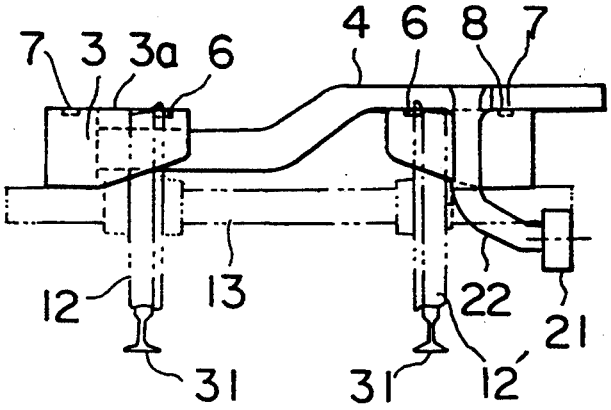
Figure 30B:
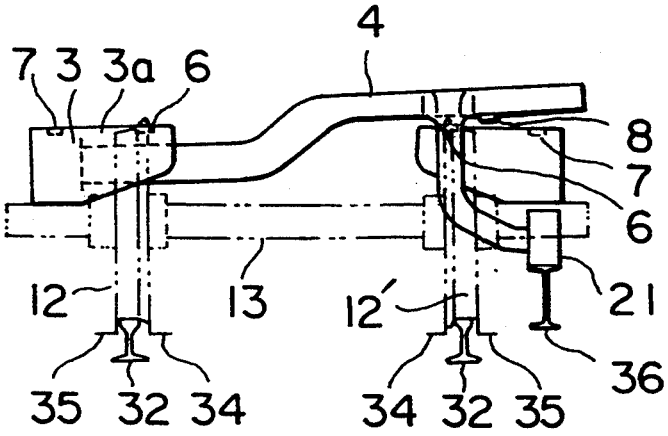
Figure 30C:
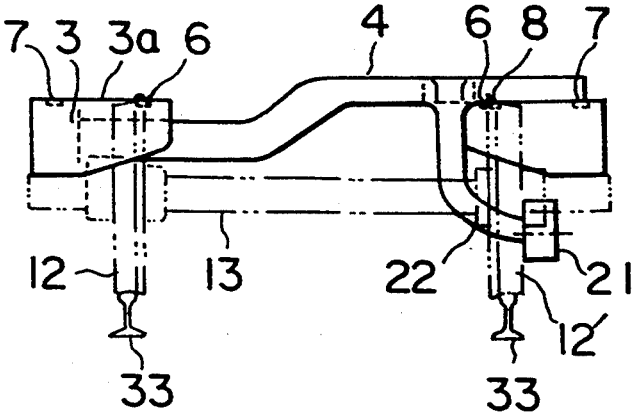

FIG. 30A, 30B and 30C are elevational views of side beams, an auxiliary wheel, a transom and a wheel of a truck shown in FIGS. 27A to 27B, at positions A and B, at positions C and D, and at positions F and G, similarly to FIGS. 7A, 7B and 7C, respectively.

Figure 31A:
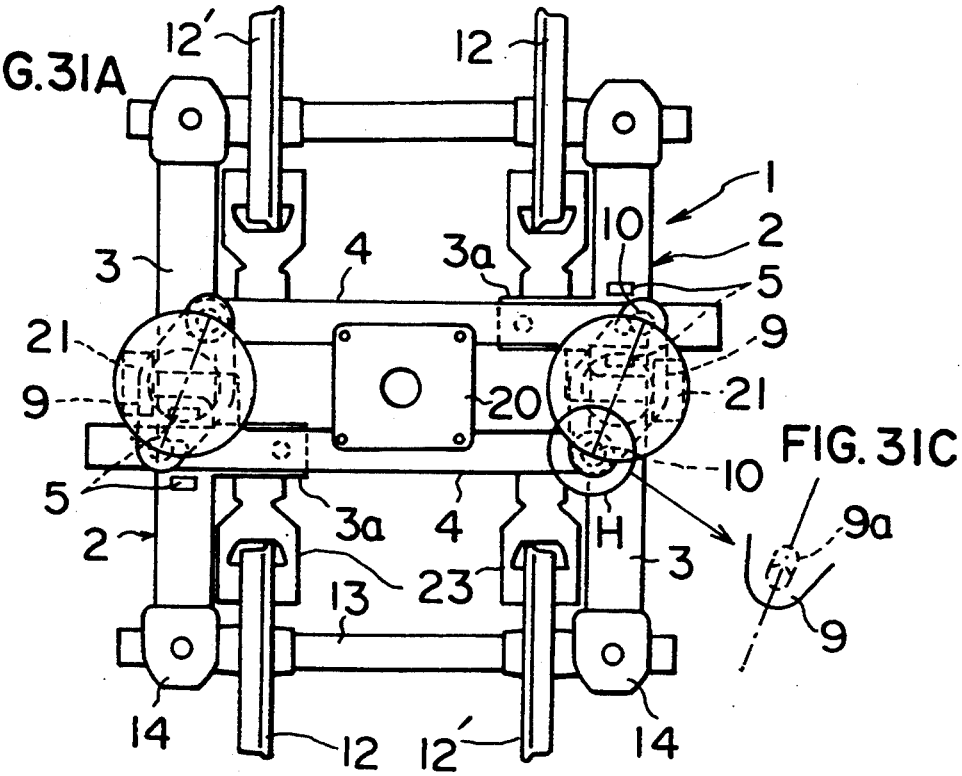
Figure 31B:
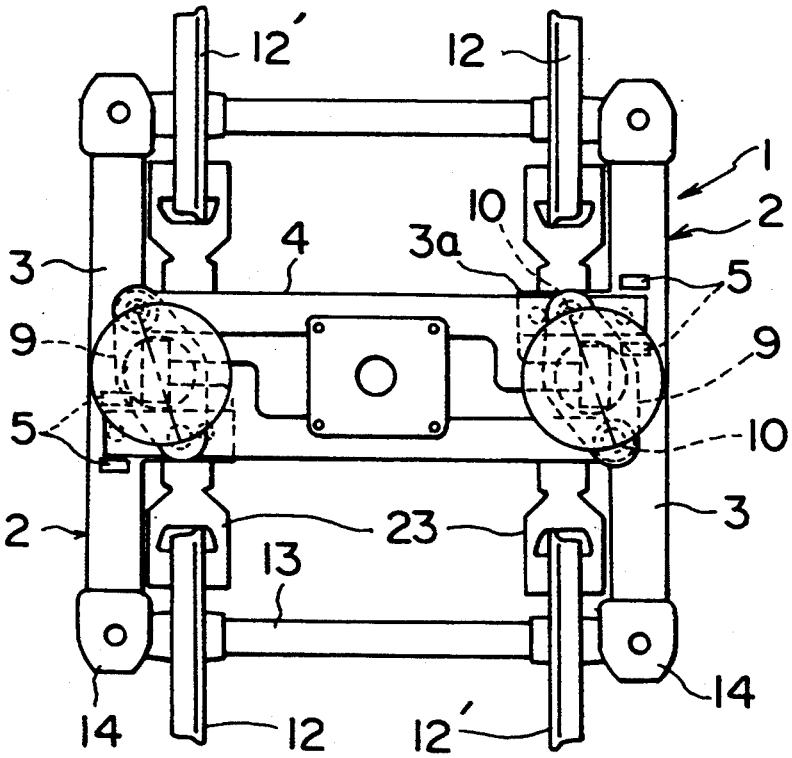

FIGS. 31A to 31C, similar to FIGS. 8A to 8C, show a variable wheel-spacing truck according to the fourth embodiment as applied to a tracted truck, wherein FIGS. 31A and 31B are plan views for a narrower track gauge and for a wider truck gauge, respectively; and FIG. 31C is an enlarged view of part H of the truck of FIG. 31A.

Figures 11A, 11B, 11C:
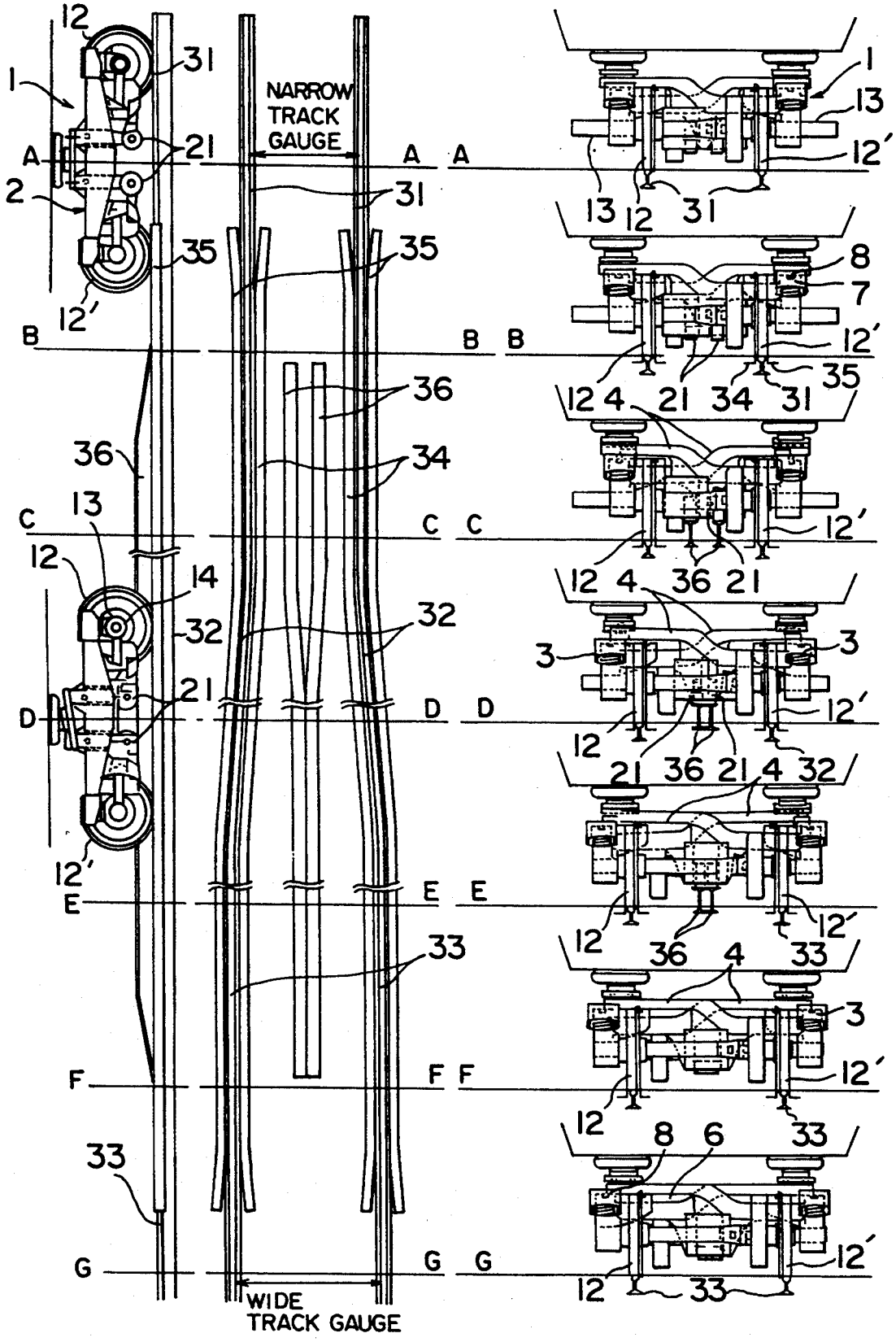
Figures 12A, 12B:
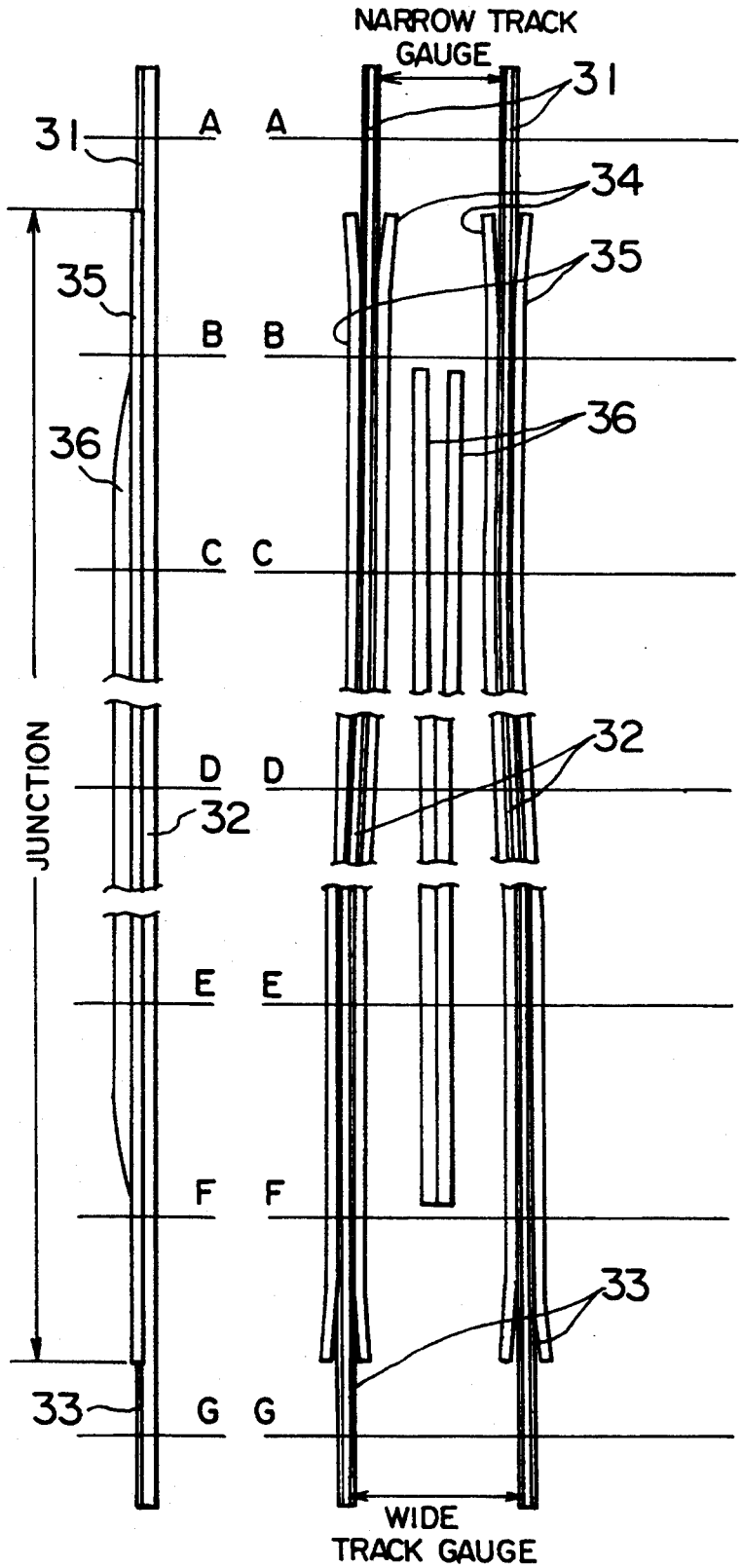
Figure 13A:
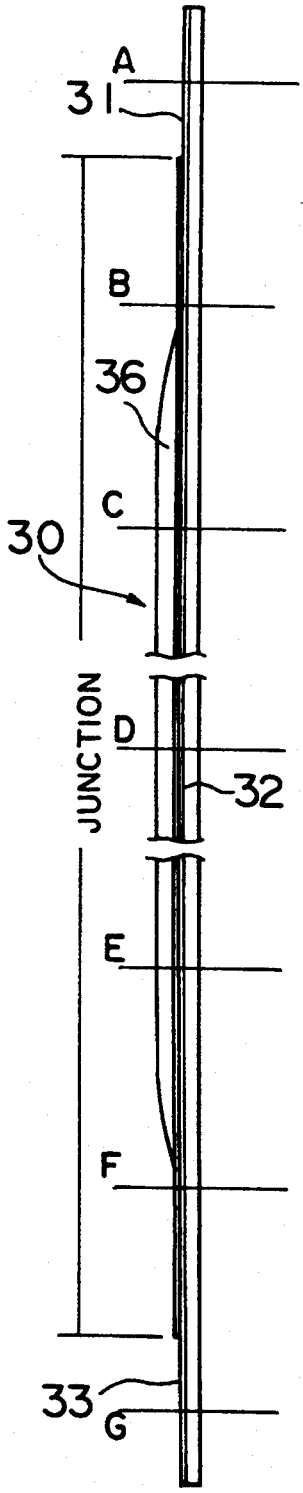
Figure 13B:
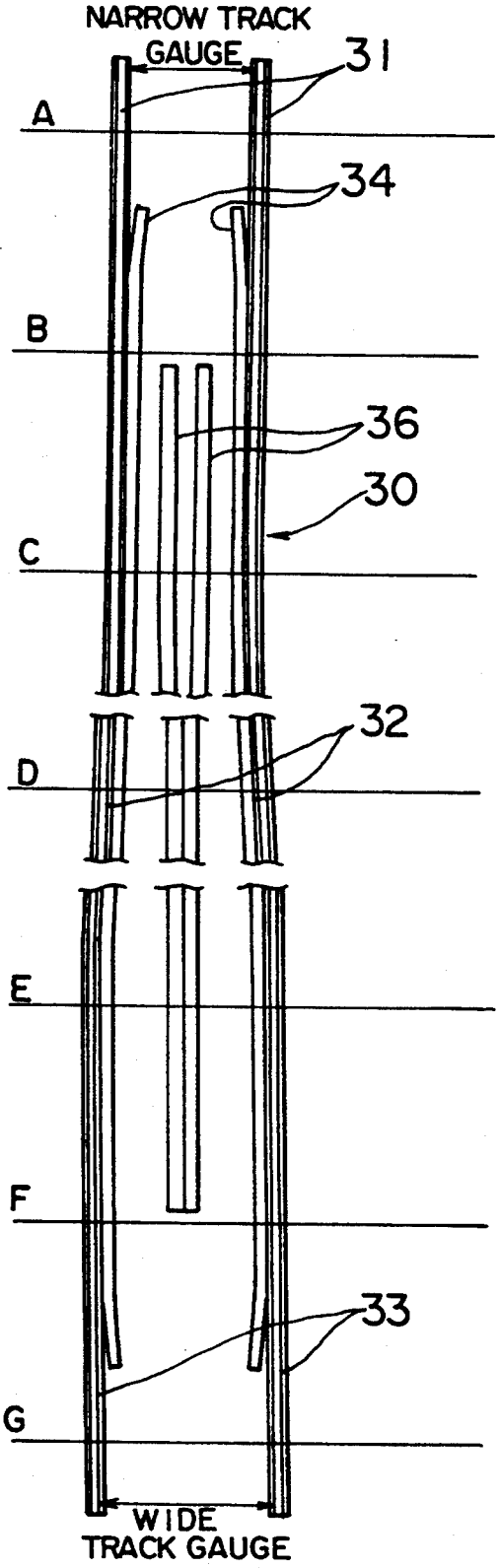
Figure 14A:
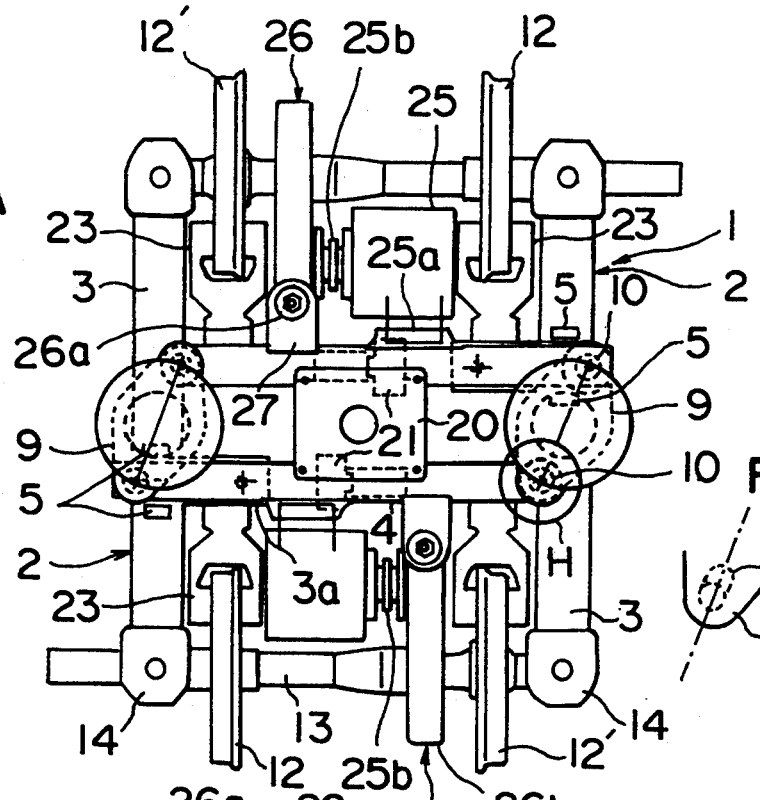
Figure 14C:
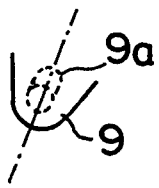
Figure 14B:
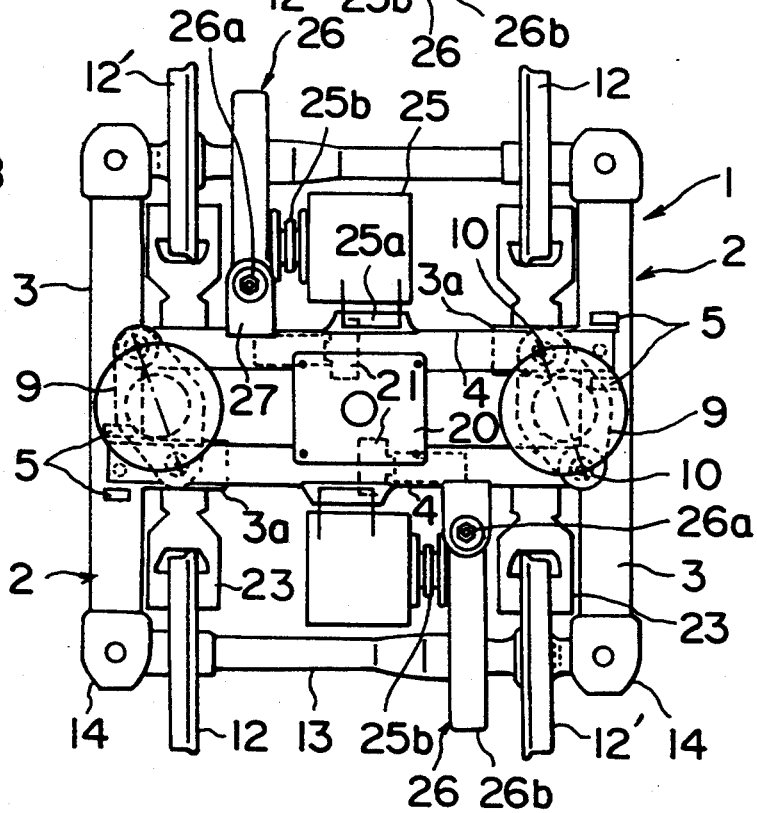
Figures 32A, 32B, 32C:
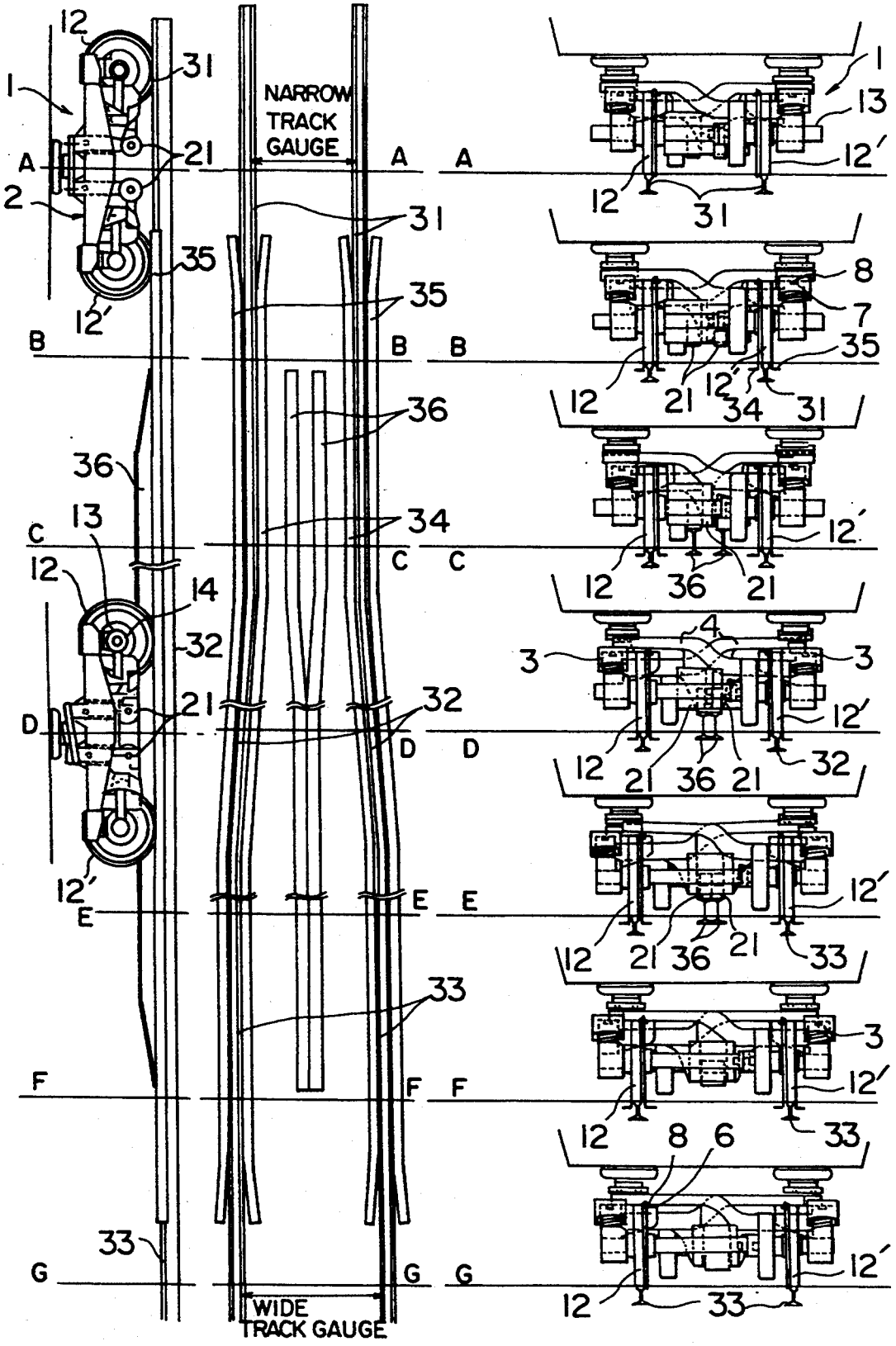

FIGS. 32A to 32C show a sequence of changing a truck wheel-spacing or track gauge similarly to FIGS. 11A to 11C, wherein FIG. 32A is a side view of a self-propelled truck according to a second embodiment of a variable gauge truck of the second type, namely a fifth embodiment of the present invention, and a ground facility including running paths disposed inside of both rails; FIG. 32B is a plan view of the ground facility shown in FIG. 32A; and FIG. 32C is a series of elevational elevational views of the truck shown in FIG. 32A when standing at locations A to G during a truck wheel-spacing changing operation.

FIGS. 33A to 33C show a variable wheel-spacing truck according to the fifth embodiment, wherein FIG. 33A is a plan view for a narrower track gauge and FIG. 33B is a plan view for a wider track gauge; and FIG. 33C is an enlarged view of part H of the truck shown in FIG. 33A.

Figure 15A:
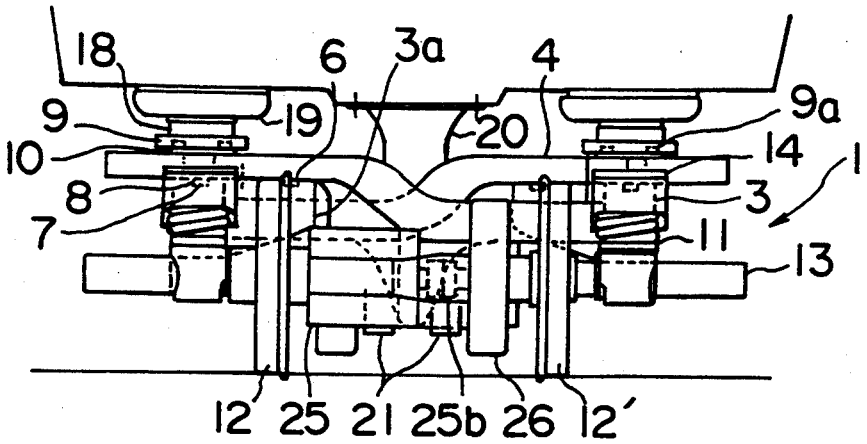
FIGS. 15A and 15B are elevational views of the variable wheel-spacing truck shown in FIGS. 14A to 14C for a narrower track gauge and for a wider track gauge, respectively.
Figure 15B:
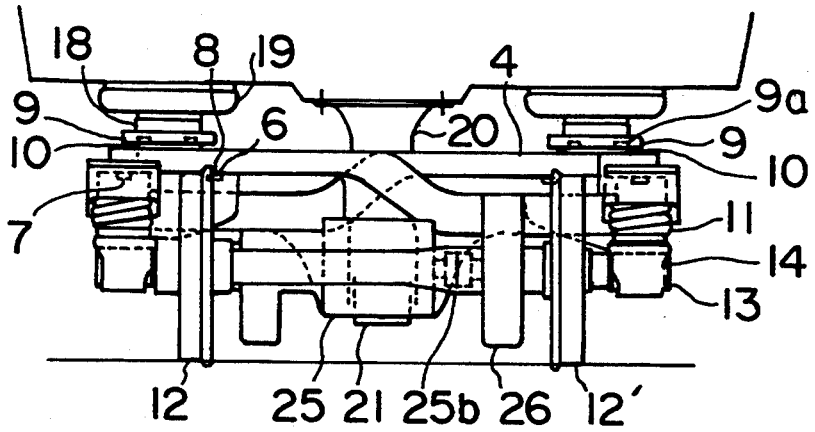
Figure 34A:
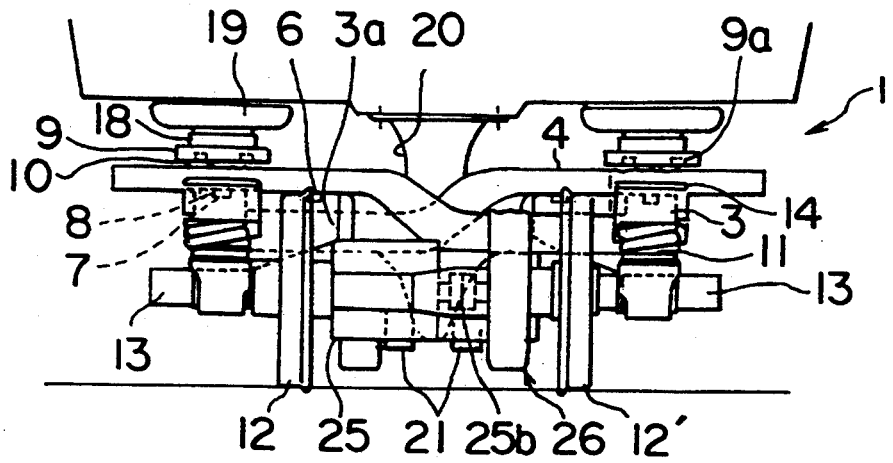
Figure 34B:
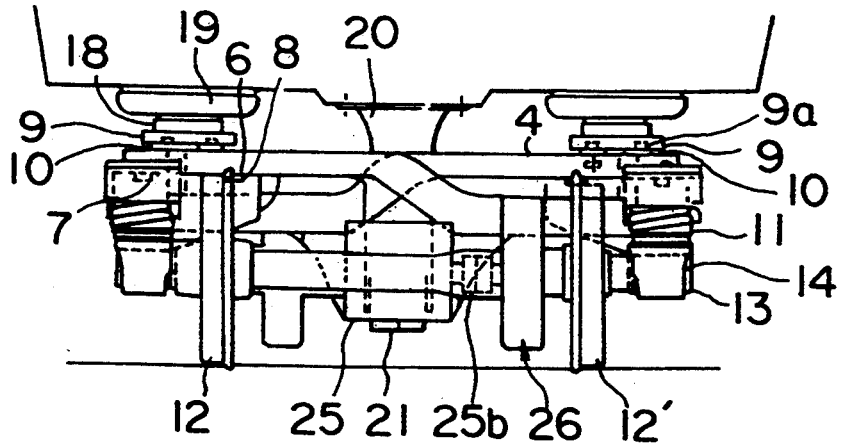

FIGS. 34A and 34B similar to FIGS. 15A and 15B, are elevational views of the truck shown in FIGS. 33A to 33C for a narrower track gauge and for a wider track gauge, respectively.

Figure 16:
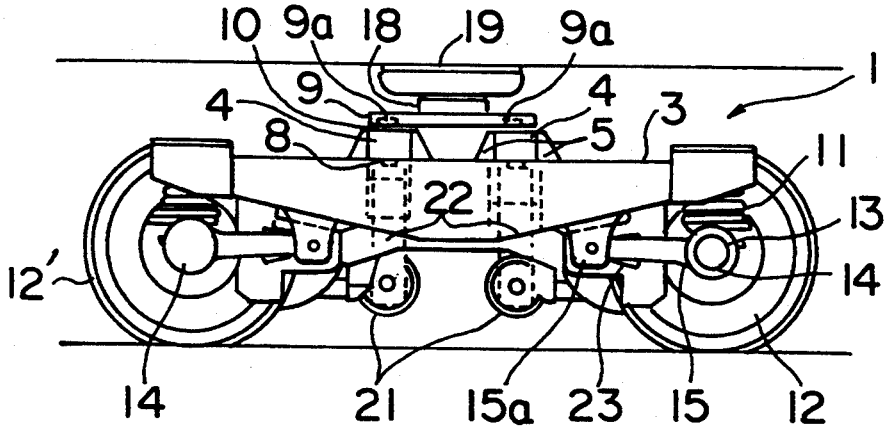
FIG. 16 is a side view of the truck shown in FIGS. 14A and 14B when an auxiliary wheel is not acting.
Figure 35:
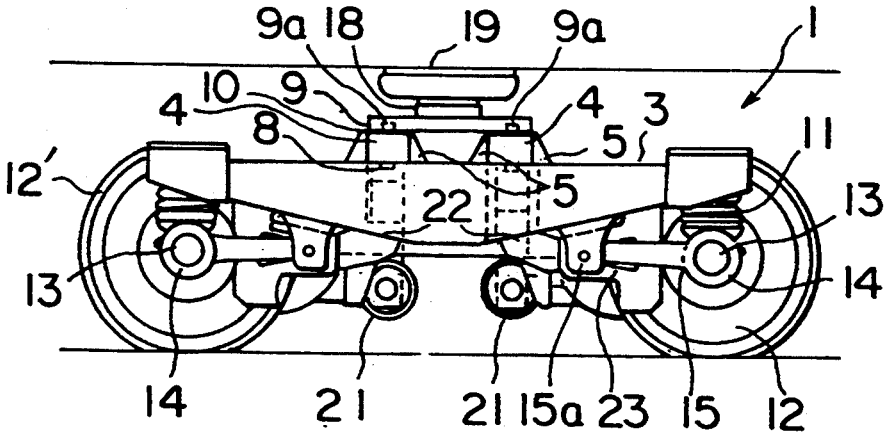

FIG. 35, similar to FIG. 16, is a side view of a truck shown in FIGS. 33A to 33C when an auxiliary wheel is not acting.

Figure 36A:
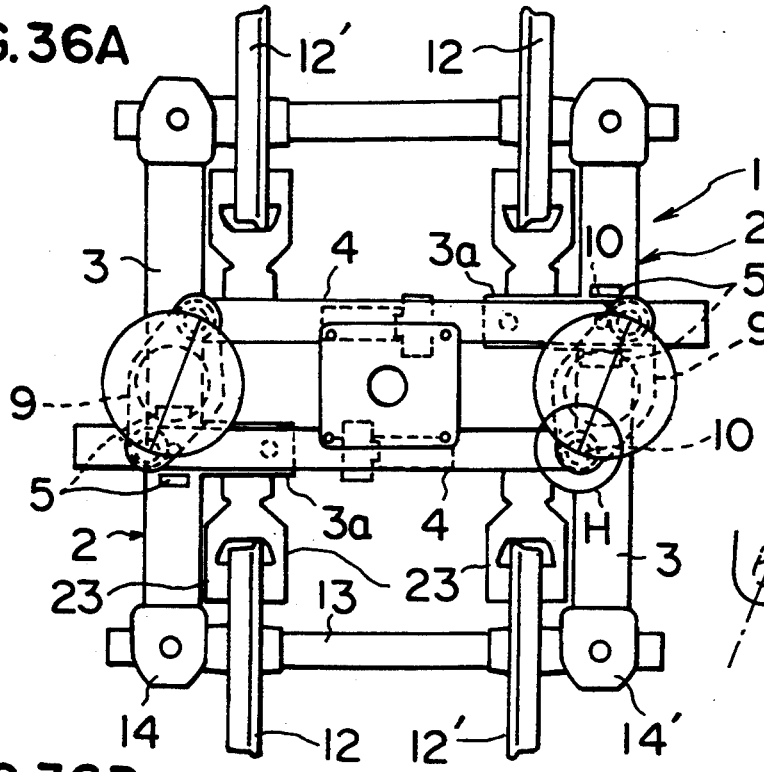
Figure 36C:
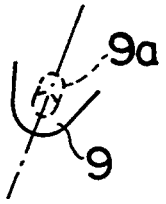
Figure 36B:
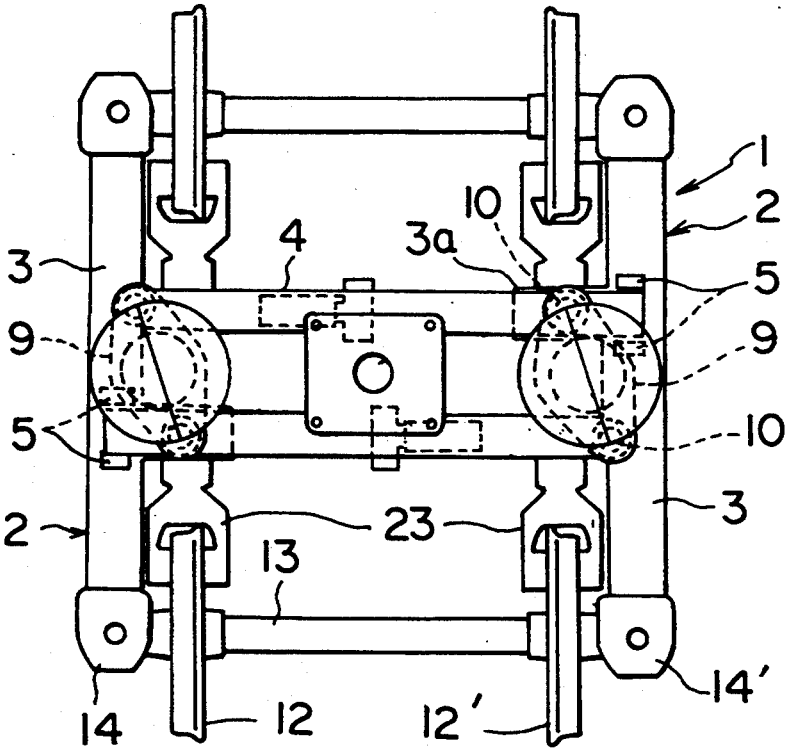

FIGS. 36A to 36C, similar to FIGS. 17A to 17C, show a variable wheel-spacing truck according to the fifth embodiment as applied to a tracted truck, wherein FIGS. 36A and 36B are plan views for the case of a narrower track gauge and for the case of a wider track gauge, respectively; and FIG. 36C is an enlarged view of part H of the truck shown in FIG. 36A.

Figure 18A:
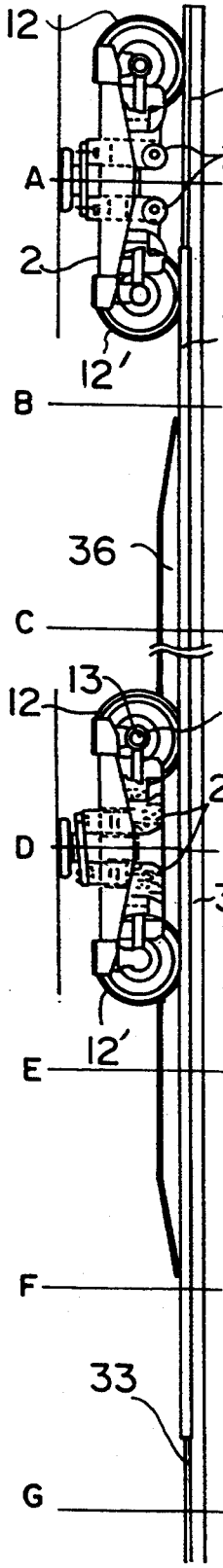
Figure 18B:
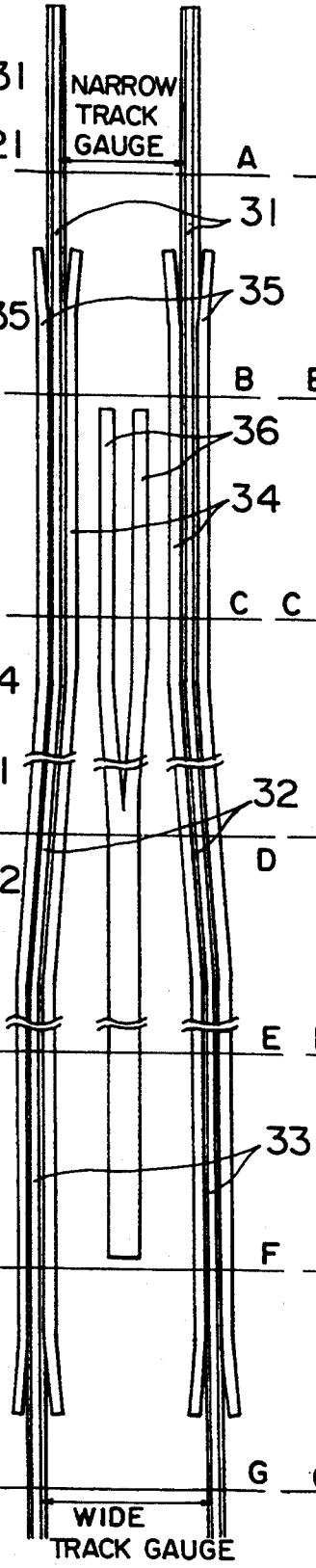
Figure 18C:
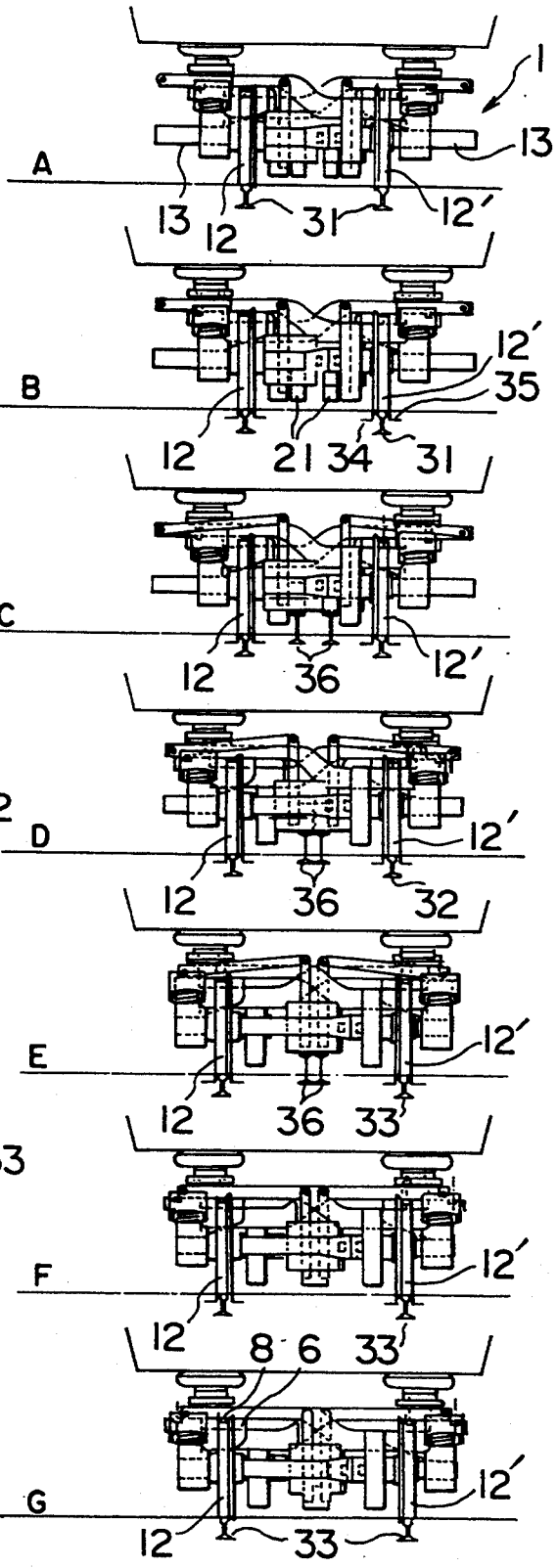
Figures 37A, 37B, 37C:
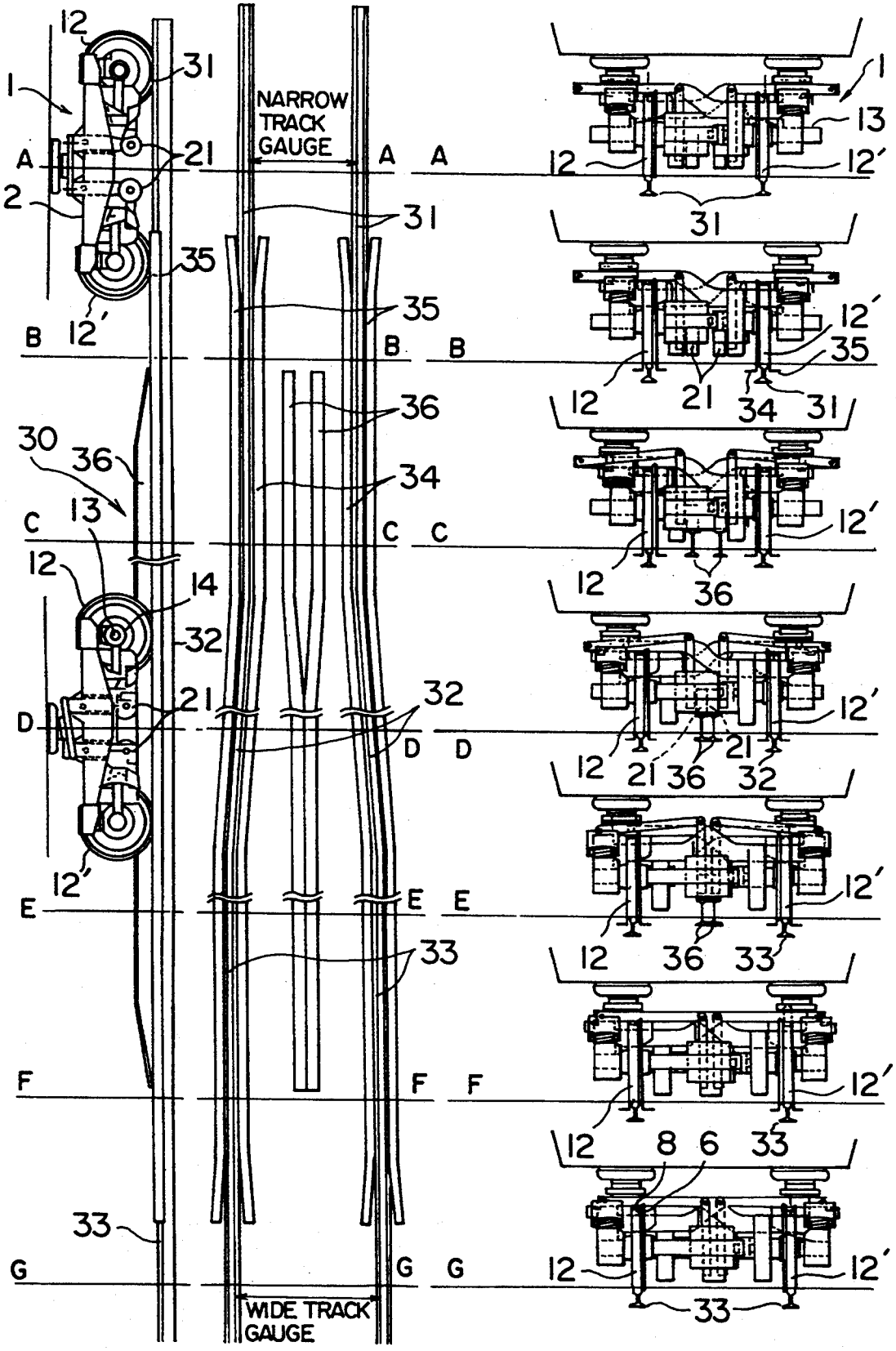

FIGS. 37A to 37C, similar to FIGS. 18A to 18B, show a sequence of changing a truck wheel-spacing or track gauge wherein FIG. 37A is a side view of a self-propelled truck according to a third embodiment of a variable gauge truck of the second type, namely a sixth embodiment of the present invention and a ground facility including running paths disposed inside of both rails; FIG. 37B is a plan view of the ground facility shown in FIG. 37A; and FIG. 37C is a series of elevational views of the truck shown in FIG. 37A when standing at locations A to G upon a truck wheel-spacing changing operation.

Figure 38A:
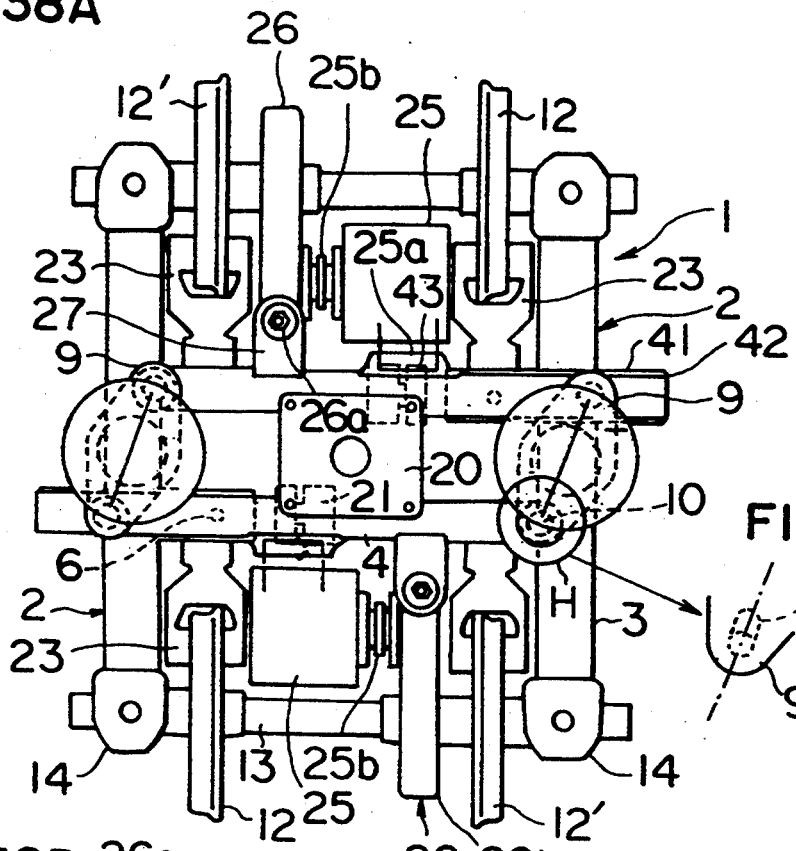
Figure 38C:
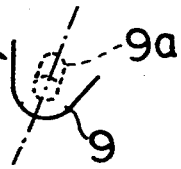
Figure 38B:
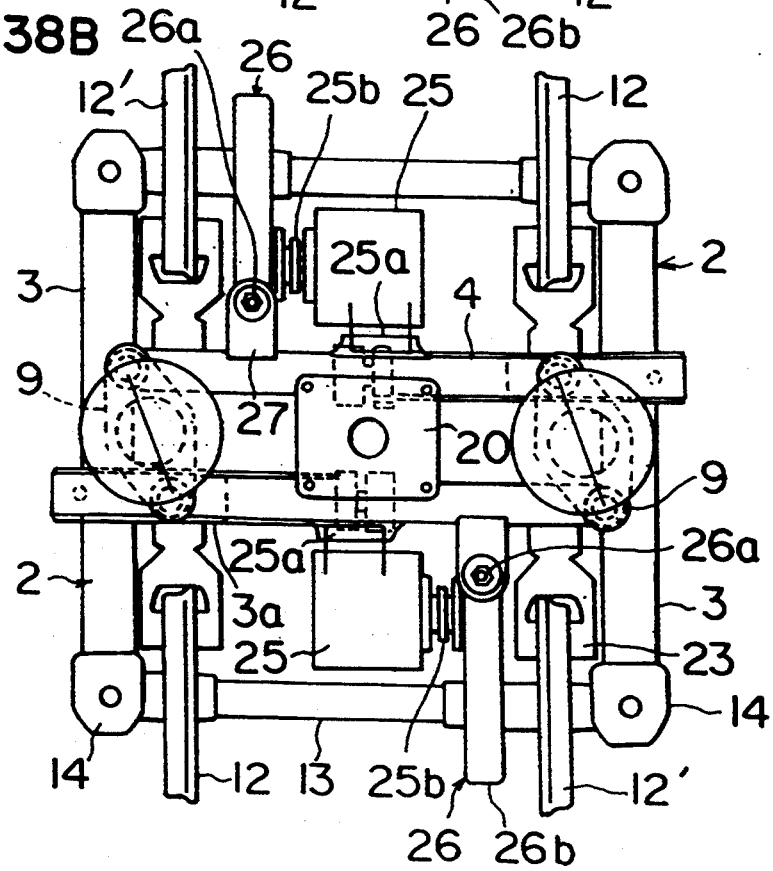

FIGS. 38A to 38C, similar to FIGS. 19A to 19B, show a variable wheel-spacing truck according to the sixth embodiment, wherein FIG. 38A is a plan view for the case of a narrower track gauge and FIG. 38B is a plan view for the case of a wider track gauge; and FIG. 38C is an enlarged view of part H of the truck shown in FIG. 38A.

Figure 20A:
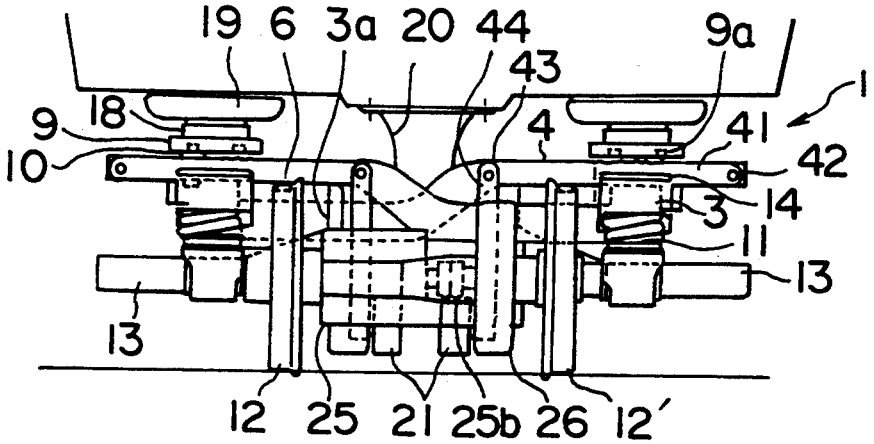
FIGS. 20A and 20B are elevational views of the variable wheel-spacing truck shown in FIGS. 19A to 19C for a narrower track gauge and for a wider track gauge, respectively.
Figure 20B:
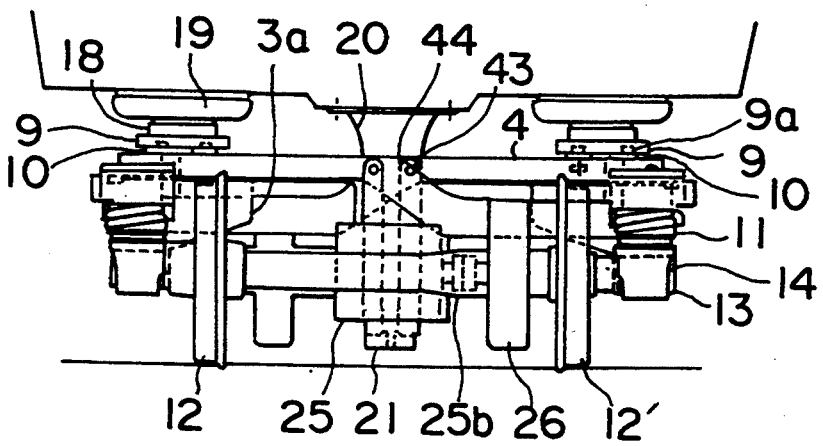
Figure 39A:
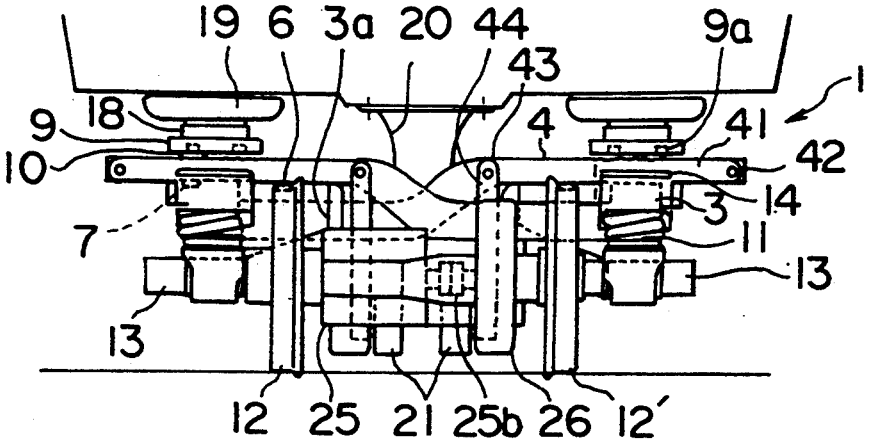
Figure 39B:
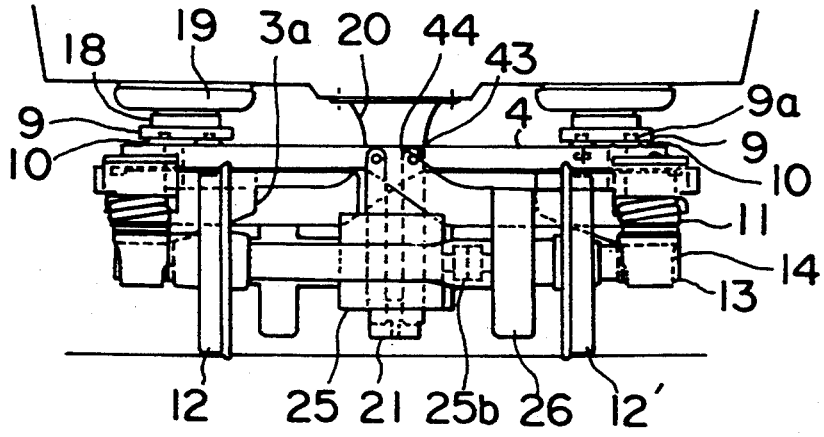

FIGS. 39A and 39B are elevational views of the truck shown in FIGS. 38A to 38C for the case of a narrower track gauge and for the case of a wider track gauge, respectively, similarly to FIGS. 20A and 20B.

Figure 40:
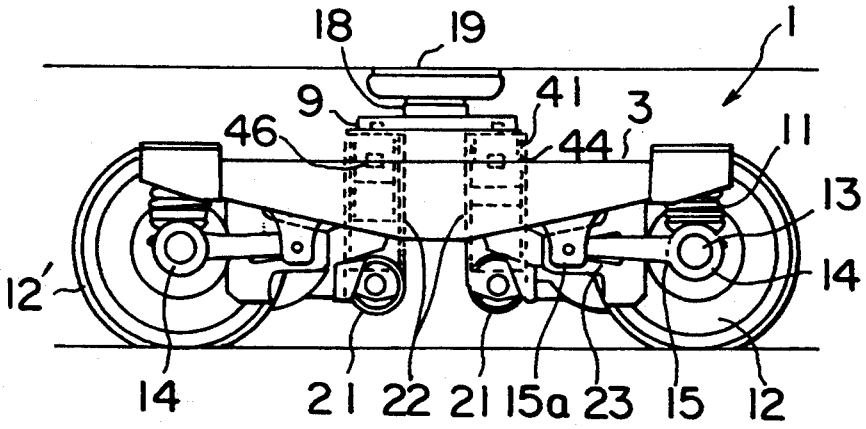

FIG. 40, similar to FIG. 21, is a side view of a variable wheel-spacing truck shown in FIGS. 38A to 38C when an auxiliary wheel is not acting.

FIGS. 41A to 41C, similar to FIGS. 23A to 23C, show a variable wheel-spacing truck according to the sixth embodiment as applied to a tracted truck, wherein FIGS. 41A and 41B are plan views for the case of a narrower track gauge and for the case of a wider track gauge, respectively; and FIG. 41C is an enlarged view of a part of the truck shown in FIG. 41A.

DETAILED DESCRIPTION OF THE PREFERRED EMBODIMENTS

Referring to the attached drawings, embodiments of a variable wheel-spacing truck and a ground facility therefor as well as a truck wheel-spacing changing method according to preferred embodiments of the present invention will be described below.

Figure 9:
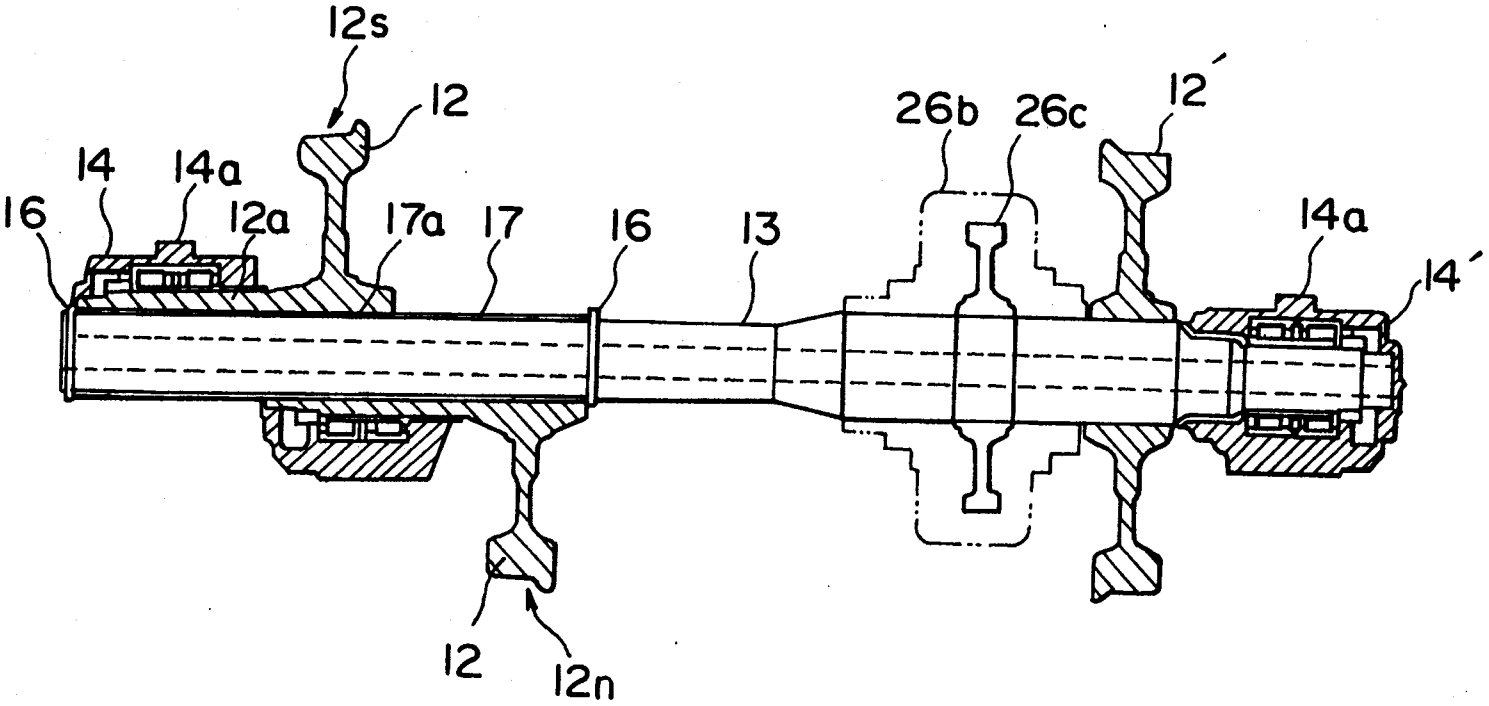
FIG. 9 is an enlarged sectional view of a wheel shaft of a self-propelled truck according to an embodiment of the first type of the present invention, wherein the upper potion of the figure shows the shaft for the case of a wider track gauge or wheel-spacing, while the lower portion of the figure shows the case of a narrower track gauge or wheel-spacing.
Figure 10:
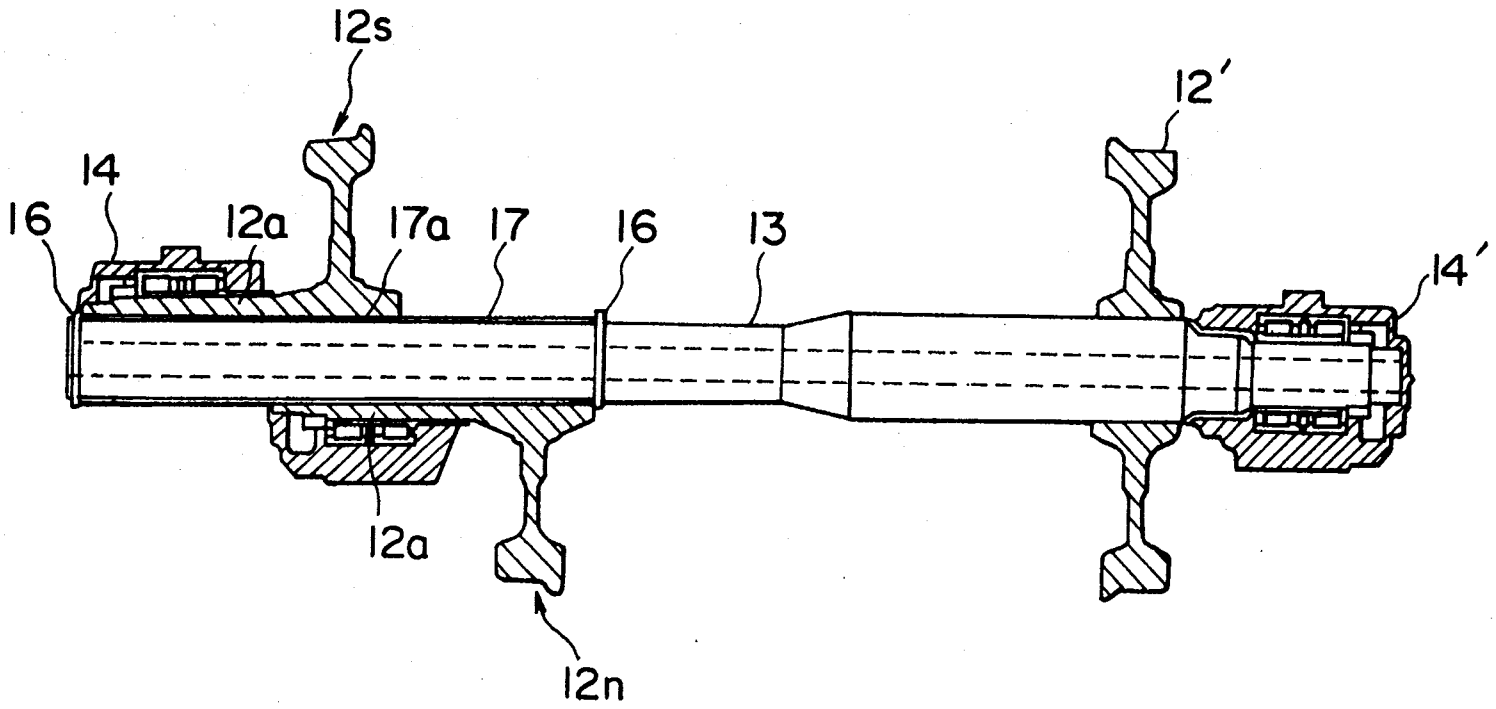
FIG. 10 is an enlarged sectional view of a wheel shaft of a tracted truck according to an embodiment of the first type of the present invention, wherein the upper portion of the figure shows the shaft for the case of a wider wheel-spacing or track gauge, while the lower portion of the figure shows the case of a narrower wheel-spacing or track gauge.

There are three embodiments of a variable wheel-spacing truck of a first type, in which one of a pair of wheels is slidable relative to the wheel shaft in the axial direction of the shaft and the other wheel is prevented from moving axially relative to the wheel shaft. FIGS. 1A to 8C show arrangements for a wheel-spacing changing method to be used for the variable wheel-spacing truck according to a first embodiment, in which running paths for auxiliary wheels are arranged outside of a railway track, and locking means for prohibiting change of the wheel-spacing are released by the help of a force from an auxiliary wheel. FIGS. 11A to 17C show arrangements for a wheel-spacing changing method to be used for a variable wheel-spacing truck according to a second embodiment, in which running paths for auxiliary wheels are arranged inside of a railway track, and locking means for prohibiting the change of the wheel-spacing are released by the help of a force from an auxiliary wheel. FIGS. 18A to 23C show arrangements for a wheel-spacing changing method to be used for a variable wheel-spacing truck according to a third embodiment, in which running paths for auxiliary wheels are arranged inside of a railway track, and a lock pin constituting a part of locking means for prohibiting the change of the wheel-spacing is released by the help of a force from an auxiliary wheel. FIG. 9 and 10 are common to the trucks according to the above embodiments.

FIGS. 1A is a side view of a ground facility for changing a truck wheel-spacing and a variable wheel-spacing truck according to the first embodiment, standing typically at a location A and at a location D; FIG. 1B is a plan view of the track gauge-change ground facility; and FIG. 1C is a series of elevational views of the ground facility and the variable wheel-spacing truck according to the first embodiment when standing at locations A to G.

Referring to FIGS. 1A to 1C, a sequence of changing the wheel-spacing from a magnitude for a narrower track gauge to a magnitude for a wider track gauge will now be explained following description, details of structure of truck 1 are shown in FIGS. 4A to 10.

At location A, a variable wheel-spacing truck 1 runs on rails 31, 31 of a narrower track gauge railway.

At location B, each of a pair of wheels 12, 12' have intruded between an inside guide rail 34 and an outside guide rail 35.

At location C, as auxiliary wheels 21 run on running paths 36, the auxiliary wheels 21 are raised upwards, whereby tip portions of transverse beams 4 of bogie frames 2 are also raised and projections 8 formed on lower surfaces of the transverse beams 4 are drawn out of positioning holes 7 located on outer portions of side beams 3, thereby allowing the pair of wheels 12, 12' and the bogie frames 2, 2 to move relative to each other in an extending direction of the rail lead tie, i.e. the axial or longitudinal direction of a shaft 13.

At location D, the wheels 12, 12' move from rails 31, 31 of the narrower track gauge railway to rails 32, 32 of a junction railway section, whereby the back-gauge-side surfaces of the wheels 12, 12' are pressed outwards by the inside guide rails 34, 34 and the spacing between two wheels 12, 12' is gradually increased or widened as the truck moves along the rails 32, 32 of the junction railway section. According to the widening of the spacing between the wheels 12, 12', the spacing between the bogie frames 2, 2 supporting these wheels is also widened. Since the fixed wheel 12' is fixed to the wheel shaft 13, the slidable wheel 12 slides outwards on the wheel shaft 13.

At location F, the running paths 36 are already terminated, and the auxiliary wheels 21, 21 are lowered to the original level, whereby the tip portions of the transverse beams 4, 4 are also lowered and the projections 8, 8 formed on the lower surfaces of the transverse beams 4, 4 of the bogie frames 2, 2 intrude into the positioning holes 6, 6 in inner portions of the side beams 3, 3 to position the side beams 3, 3 so as to prevent or lock a relative motion between the pair of bogie frames 2, 2. At the same time, the slidable wheel 12 is also fixed to the wheel shaft 13 at a predetermined position, thereby maintaining the spacing between the wheels 12, 12' at a constant value corresponding to a new, i.e. wider, track gauge.

At location G, the wheels 12, 12' come out from between the inside guide rails 34, 34 and the outside guide rails 35, 35, and the truck 1 is allowed to run on rails 33, 33 of a wider track gauge railway.

Passing through the locations from A to G, the spacing between the wheels 12, 12' of the truck 1 is changed from a narrower one to a wider one. In contrast, when the truck 1 moves from a wider track gauge railway to a narrower track gage railway, the difference from the above case resides only in that the wheels 12, 12' are pressed by the rails 32, 32 of the junction railway section and the outside guide rails 35, 35, or by the rails themselves, and the other features are the same as above.

Figures 2A, 2B:
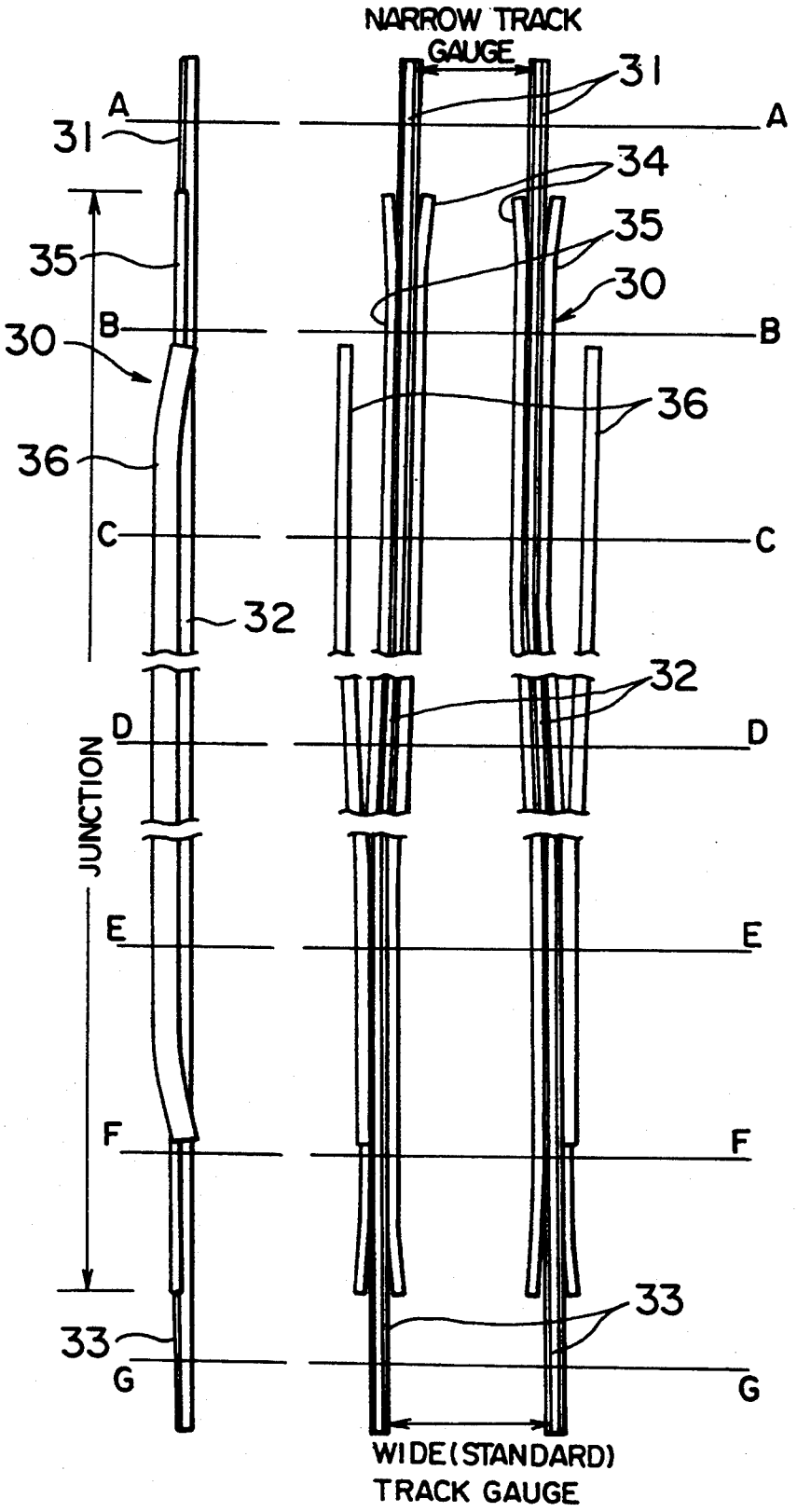

FIG. 2A is a right side view of the ground facility to be used for a variable wheel-spacing truck according to the first embodiment, and FIG. 2B is a plan view of the same.

As shown in FIGS. 2A and 2B, the ground facility 30 comprises a pair of narrower track gauge rails 31, 31, a pair of wider track gauge rails 33, 33, junction rails 32, 32 connecting the narrower track gauge rails 31, 31 with wider track gauge rails 33, 33, a pair of inside guide rails 34, 34 for pressing the back-gauge-sides of the wheels 12, 12' over the whole length of the junction railway 32, 32 section, a pair of outside guide rails 35, 35 for pressing the outside surfaces of the wheels 12, 12' over the whole length of the junction railway 32, 32 section, and a pair of left and right running paths 36, 36 on which the auxiliary wheels 21, 21 pass.

The pair of inside guide rails 34, 34 are continuously arranged inside of the rails 31, 32, and 33 and separated therefrom by a predetermined distance depending on the location. The top surfaces of the inside guide rails 34, 34 have a function of pressing the wheels 12, 12' and are positioned a little higher than the top surfaces of the rails 31, 32 and 33. Similarly, the pair of outside guide rails 35, 35 are continuously arranged outside of the rails 31, 32, and 33 and separated therefrom by a predetermined distance depending on the locations. The top surfaces of the outside guide rails 35, 35 have a function of pressing the wheels 12, 12' and are also or similarly positioned a little higher than the top surfaces of the rails 31, 32 and 33. Furthermore, both end portions of the inside guide rails 34, 34 and the outside guide rails 35, 35 are bent in directions away from the rails 31, 31 or the rails 33, 33 so that the wheels 12, 12' may smoothly intrude between the rails 31, 31 or the rails 33, 33 and the inside guide rails 34, 34 or the outside guide rails 35, 35.

The length of the running paths 36, 36 is shorter than the length of the inside guide rails 34, 34 or the outside guide rails 35, 35. The right running path 36 is arranged in parallel to the left rails 31, 32 and 33, while the left running path 36 is arranged in parallel to the right rails 31, 32 and 33. Furthermore, as shown in FIG. 7B, height of the running surface of each running path 36 is determined so as to raise the auxiliary wheel 21 so that, in running from the location C to location E, the projection 8 projecting from the lower surface of the transverse beam 4 of the bogie frame 2 escapes from the positioning hole 6 or 7 formed in the inner or outer portion of the side beam 3, and accordingly, the pair of wheels 12, 12' together with the bogie frames 2, 2 become free to slide relative to each other in the extending direction of the rail road tie, i.e., the axial or longitudinal direction of the shaft 13. The end portions of each running path 36 are inclined downwards for allowing a smooth transitional running of the auxiliary wheel 21.

Figures 3A, 3B:
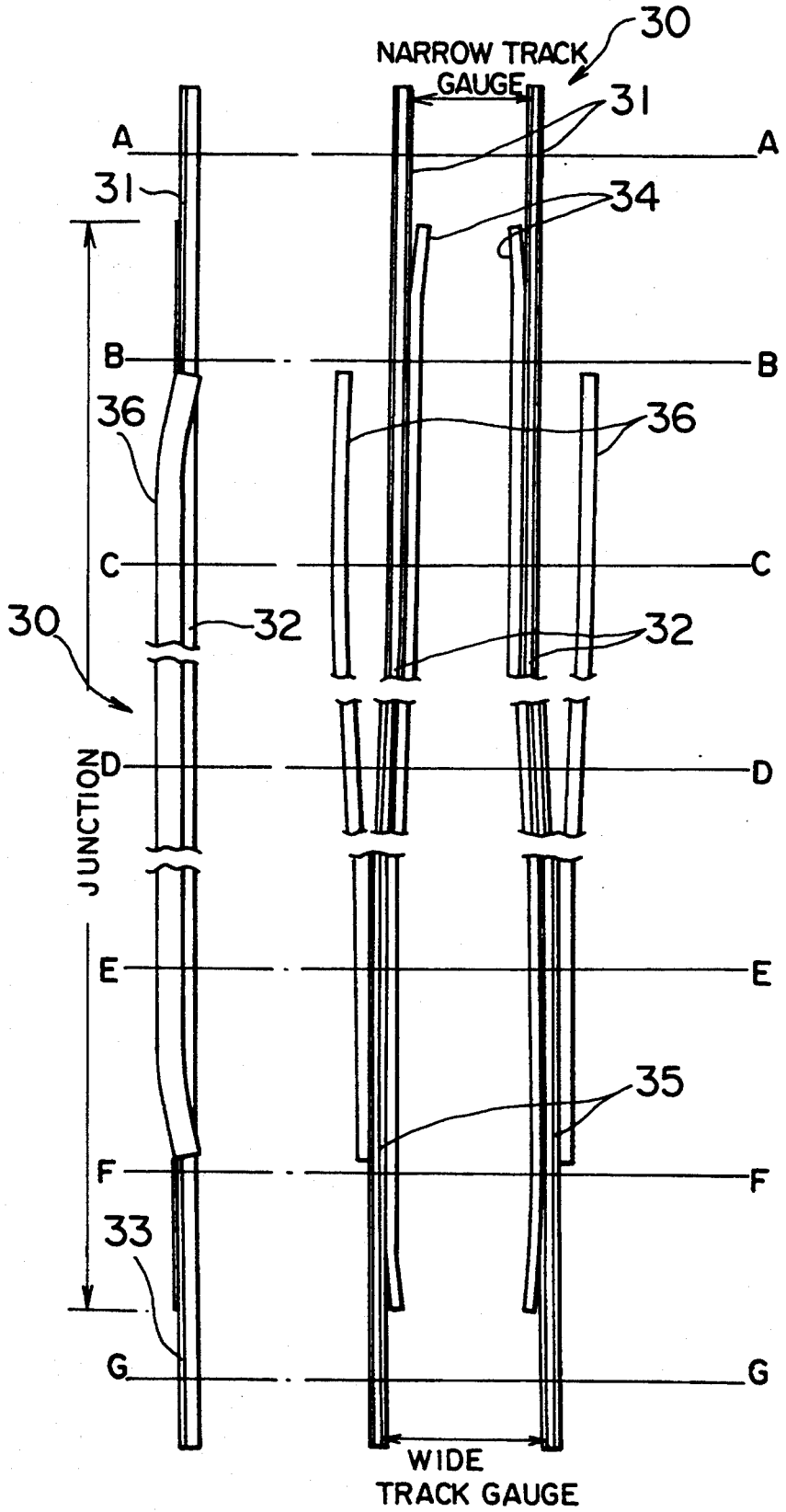

FIG. 3A is a right side view of another embodiment of a ground facility to be used for the variable wheel-spacing truck according to the first embodiment, and FIG. 3B is a plan view of the same. FIGS. 3A and 3B show a modification of the ground facility shown in FIGS. 2A and 2B, in which no outside rail 35 is arranged.

In the ground facility shown in FIGS. 2A and 2B, the vehicle is allowed to intrude from a narrower track gauge railway as well as from a wider track gauge railway side. A ground facility provided with no guide rail or only outside rails as in FIGS. 3A and 3B is suitable to be used when a vehicle intrudes only from a wider track gauge railway, while a ground facility provided with only inside guide rails is suitable to be used when a vehicle intrudes only from the narrower track gauge railway.

FIGS. 4A to 6 show, in detail, the first embodiment of the variable wheel-spacing truck. FIGS. 4A and 4B are plan views of the variable wheel-spacing truck locating at location A on the narrower track gauge railway and at location G on the wider track gauge railway, respectively; FIGS. 5A and 5B are elevational views of the variable wheel-spacing truck located at position A on the narrower track gauge railway and at location G on the wider track gauge railway, respectively; and FIG. 6 is a side view of the variable wheel-spacing truck.

As shown in FIG. 4A, the variable wheel-spacing truck 1 according to this embodiment comprises a pair of left and right T-shaped bogie frames 2, 2 opposed to each other, and each of the bogie frames 2, 2 includes a side beam 3 and a transom 4 fixed to and extending from the intermediate or middle portion of the side beam 3, while the tip portion of the transom 4 of one bogie frame 2 movably intersects the side beam 3 of the other bogie frame 2. In order to obtain a suitable relative motion between the transom 4 of one bogie frame 2 and the side beam 3 of the other bogie frame 2, a pair of guide members 5, 5 are arranged on each side beam 3 to receive the transom 4 between the guide members 5, 5.

At an intersecting region of the side beam 3 with the transom 4 is provided a supporting portion 3*a* integral with the side beam 3 and extending transversely inwards of the truck 1. In the supporting portion 3*a* and in the side beam body 3 are positioning holes 6 and 7 with a predetermined interval therebetween, and on the lower surface of the tip portion of the transom 4 is formed a projection 8, which can selectively intrude into the positioning hole 6 or 7. In this embodiment, the positioning holes 6 and 7 and the projection 8 constitute a locking means for the side beam 3 of one bogie frame 2 and the transom 4 of the other bogie frame 2.

On the tip portion of the transom 4 is rotatably mounted, through a J-shaped arm member 22, an auxiliary wheel 21, which serves as a means for releasing a locking condition between the transom 4 and the side beam 3. During a wheel-spacing changing operation, this auxiliary wheel 21 runs or rolls on the running path 36, whereby the auxiliary wheel 21 raises the tip portion of the transverse beam 4 and releases a fitted condition between the positioning hole 6 or 7 and the projection 8.

Although there is shown only one example of the auxiliary wheel 21, it should be understood that a sliding member, which only slides, but does not rotate, is also encompassed by the term "auxiliary wheel". In this case, however, the influence of abrasion and the force of friction should be taken into consideration.

The transverse beams 4, 4 of the pair of T-shaped bogie frames 2, 2 are pivotally connected with each other in the form of a parallelogram linkage by use of a pair of left and right link members 9, 9. More specifically, on an upper surface of a root portion of one transom 4 and on an upper surface of the tip portion of the other transom 4 are formed respectively semispherical projections 10, which are inserted into engaging recesses 9*a*, 9*a* formed in a lower surface of each of the link members 9, 9 for pivotally connecting the link members 9, 9 with the bogie frames 2, 2. Each of the engaging recesses 9*a*, 9*a* has an elongated shape extending along a line connecting a pair of the engaging recesses 9*a*, 9*a* as shown in FIG., 4C for the purpose of making it possible to maintain a spacing between the front and rear transverse beams 4, 4 at a predetermined value when one bogie frame 2 is transversely moved relative to the other bogie frame 2 during a wheel-spacing changing operation. In order to support the vehicle weight at fixed support points at all times whenever the vehicle runs on the narrower track gauge railway, en the junction railway or on the wider track gauge railway, an elastic body 19 such as a pheumatic spring is mounted on each link member 9 at a central portion thereof via an elastic body 18 such as a layered rubber and supports the vehicle weight. A traction device 20 disposed at a central portion of the vehicle is provided for transmitting a traction force to the vehicle, and the vehicle weight is not applied thereto. In this case, the link members 9 and elastic bodies 18 and 19 mainly constitute a vehicle weight supporting means.

Brake device 23 provided for each of the wheels 12, 12' is supported by the transom 4 and the supporting portion 3*a* so that the brake device 23 moves together with an associated one of the wheels 12, 12' upon a wheel-spacing changing operation.

The variable wheel-spacing truck according to this embodiment is a self-propelled one. Driving motors 25 are mounted on the front and rear transverse beams 4 via brackets 25*a*, and a gear mechanism 26 is mounted on a bracket 27 of the transom 4 through a rubber bush 26*a* to be side by side with one of the driving motor 25. The gear mechanism 26 comprises a driving gear and a driven gear 26*c* engaging with each other both accommodated in a gear case 26*b*, wherein the driving gear is connected with a driving shaft of the driving motor 25 through a flexible coupling 25*b*, and the driven gear 26*c* is integrally connected with the wheel shaft 13 (see FIG. 9).

As shown in FIG. 6, under the end portions of each side beam 3 are provided an axle box or bearing box 14, on the fixed wheel 12 side, for rotatably supporting one end portion of the wheel shaft 13 and a axle box 14, on the slidable wheel 12, side for rotatably and transversely slidably supporting the wheel 12. Each of the axle boxes 14, 14' is also supported by a tip portion of a supporting member 15 which extends from a position opposed to an intermediate portion of the lower surface of the side beam 3 in a forward direction or in an rearward direction and is vertically swingably or pivotally supported at the root portion thereof by a bracket 15*a* secured to the lower surface of the side beam 3.

FIGS. 7A to 7C show the motion of a bogie frame 2 during a wheel-spacing changing operation, wherein FIG. 7A shows a state at the locations A and B on the narrower track gauge railway; FIG. 7B shows a state at the locations C to E where the auxiliary wheel 21 runs on the running path 36, in the junction region, with the tip portion of the transom 4 of the bogie frame 2 being raised by the auxiliary wheel 21; and FIG. 7C shows a state at the locations F and G on the wider track gauge railway.

FIGS. 8A and 8B show a variable wheel-spacing truck, according to the first embodiment, as applied to a tracted truck. FIG. 8A is a plan view of the truck standing at location A on the narrower track gauge railway, and FIG. 8B is a plan view of the truck standing at location G on the wider track gauge railway.

FIG. 9 is an enlarged sectional view of a driving shaft used in variable wheel-spacing trucks of a self-propelled type according to the first to third embodiments. As shown in FIG. 9, one wheel 12' is press-fitted around the wheel shaft 13, and the other wheel 12 is mounted around the wheel shaft 13 slidably relative to the shaft 13 in a range from position 12*s* to position 12*n* which are determined by stoppers 16. The wheel 12 may be mounted on the wheel shaft 13 so as to be prevented from rotating relative to the shaft 13 by means of a spline 17 or otherwise may be mounted through a plane bearing located at a position indicated by numeral 17*a* in FIG. 9 so as to be allowed to rotate relative to the shaft 13. The axle box 14' on the fixed wheel 12' side rotatably supports one end portion of the wheel shaft 13, while the axle box 14 on the slidable wheel 12 side rotatably supports the wheel 12 and is able to slide together with the wheel 12. For achieving this action of the axle box 14, the wheel 12 is forged with a cylindrical portion 12*a* extending from one side of the wheel body 12 to fit around the shaft 13, while the cylindrical portion 12*a* is rotatably supported around its outer periphery by the axle box 14. The driven gear 26*c* is press-fitted around the wheel shaft 13 to form an integrated unit.

FIG. 10 is an enlarged sectional view of a wheel shaft installed in the variable wheel-spacing truck of a tracted type according to the first to third embodiments. This wheel shaft has the same structure and function as the driving shaft shown in FIG. 9, except that the wheel shaft 13 is not equipped with a driven gear 26*c*.

FIGS. 11A to 17C show a second embodiment of a variable wheel-spacing truck. This embodiment differs from the above-mentioned first embodiment in that each auxiliary wheel 21 and the associated running path 36 which are provided for raising the tip portion of the associated transom 4 to release a locking condition between the side beam 3 of one bogie frame 2 and the transom 4 of the other bogie frame 2 are arranged inside of the rails 31, 32 and 33, namely, inside of the railway track. An advantage of this arrangement in comparison with the first embodiment is that it becomes easy to limit or restrict the width of the truck to smaller than the width of the vehicle, because the auxiliary wheels 21 are not arranged outside of the above-mentioned rails 31, 32, 33. Other structures and functions are substantially the same as in the first embodiment.

FIGS. 18A to 23C show a third embodiment of a variable wheel-spacing truck, in which the auxiliary wheels 21, 21 and the running paths 36, 36 are arranged inside of the rails 31, 32 and 33 similarly to the second embodiment. The diference of this embodiment from the first and second embodiments resides in that there is provided a lock pin 46 for establishing a locking condition between the side beam 3 and the transom 4, and lever means 41, 41 adapted to be raised by the auxiliary wheel 21 for raising the lock pin 46 to release the locking condition.

FIG. 22 is an enlarged view of a positioning means according to the third embodiment of the variable wheel-spacing truck, in which the auxiliary wheel 21 is attached to an end of the transom 4 through lever members 41, 41 but not attached directly to the transom 4, differently from the first and second embodiments. More specifically, as shown in FIGS. 21 22, a pair of lever members 41 are pivotally connected at proximal end portions thereof with the tip portion 4*a* of the transom 4, and at distal end portions thereof with upper portions of arms 44, 44, while the auxiliary wheel 21 is rotatably mounted on lower end portions of the arms 44, 44. Each of the lever members 41, 41 is formed with a positioning projection 41*a* near the proximal end thereof, and a plate member 45 is formed in a lower surface thereof with positioning grooves 45*a*, 45*a* to be engaged with the positioning projections 41*a*, 41*a* and at a central portion thereof with the lock pin 46 projecting downwards.

Further, a top portion 46*a* of the lock pin 46 is semi-spherical and projects upwards from an upper surface of the plate member 45. The tip portion 4*a* of the lateral beam 4 has therethrough a through-hole 47 for passing the lock pin 46, while a body portion of the side beam 3 intersecting with the tip portion 4*a* of the transom 4 and the supporting portion 3*a* have therein positioning holes 48 an 49 for receiving a lower end of the lock pin 46 passed through the through-hole 47. By engaging the top portion 46*a* of the lock pin 46 into the groove 9*a* in the lower surface of the link member 9, the tip portions 4*a*, 4*a* of the front and rear transverse beams 4, 4 are pivotally supported add connected to the vehicle body. The reason for the elongated shape of the groove 9*a* is the same as in the first and second embodiments. Other structures are also the same as in the first and second embodiments.

Next, a variable wheel-spacing truck of a second type according to the present invention, namely, a variable wheel-spacing truck in which both of a pair of (left and right) wheels are adapted to be slidable relative to the wheel shaft in the axial direction of the shaft will be briefly described below by referring to the fourth, fifth and sixth embodiments corresponding to the first, second and third embodiments of the variable wheel-spacing truck of the first type.

FIGS. 24 and 25 are enlarged sectional views, corresponding respectively to FIGS. 9 and 10, of a wheel drive shaft equipped in a self-propelled truck and a wheel shaft equipped in a tracted truck, respectively each being applied to the variable wheel-spacing truck of each of the fourth to sixth embodiments. As shown in the figures, the wheels 12 and 12' are slidable relative to the wheel shaft 13 in a range from position 12*s* to position 12*n* and in a range from position 12's to 12'n, respectively. The wheels 12, 12' may be mounted nonrotatably on to the wheel shaft 13 through splines 17, as shown in FIGS. 24 and 25, or may be mounted rotatably thereon simply through plane bearings. The axle boxes 14 add 14' rotatably support the wheels 12 and 12', respectively, and also slide together with the associated wheels 12 and 12' relative to the wheel shaft 13. For allowing these actions of the wheel boxes 14, 14' each of the wheels 12 and 12' comprises an integrally formed cylindrical portion 12*a*, 12*a* extending outwards around the wheel shaft, while the cylindrical portions 12*a*, 12*a* are rotatably supported at the outer periphery thereof by the axle box 14 and 14', respectively. Further, the wheel 12' further comprises an integrally formed cylindrical portion 12*b* extending inwards, around which is integrally mounted the driven gear 26*c*.

FIGS. 26A to 31B relate to a variable wheel-spacing truck according to the fourth embodiment of the present invention. FIGS. 26A to 26C, FIGS. 27A to 27C, FIGS. 28A and 28B, FIG. 29, FIGS. 30A to 30C and FIGS. 31A to 31C correspond respectively to FIGS. 1A to 1C, FIGS. 4A to 4C, FIGS. 5A and 5B, FIG. 6, FIGS. 7A to 7C and FIGS. 8A to 8C relating to the first embodiment.

In this fourth embodiment, as shown in FIGS. 28A to 29, the axle boxes 14 and 14' rotatably support the wheels 12 and 12', respectively, and are adapted to slide on the wheel shaft 13 in the axial direction of the shaft 13 together with the wheels 12 and 12'.

In a variable wheel-spacing truck according to this fourth embodiment, both of the left and right wheels 12, 12 are allowed to slide relative to the wheel shaft 13 in the axial direction of the shaft at location D with the spacing between the wheels 12, 12 being changed. The operation of this fourth embodiment is the same as that of the first embodiment except for the above feature.

FIGS. 32A to 36B relate to a variable wheel-spacing truck according to a fifth embodiment of the present invention. FIGS. 32A to 32C, FIGS. 33A to 33C, FIGS. 34A and 34B, FIG. 35 and FIGS. 36A to 36C correspond respectively to FIGS. 11A to 11C, FIGS. 14A to 14C, FIGS. 15A and 15B, FIG. 16 and FIGS. 17A to 17C relating to the second embodiment. This fifth embodiment is the same as the second embodiment except that each of the wheels 12, 12' is slidable relative to the wheel shaft 13 in the axial direction of the shaft similarly to in the fourth embodiment.

FIGS. 37A to 41C relate to a variable wheel-spacing truck according to the sixth embodiment of the present invention. FIGS. 37A to 37C, FIGS. 38A to 38C, FIGS. 39A and 39B, FIG. 40 and FIGS. 41A to 41C correspond respectively to FIGS. 18A to 18C, FIGS. 19A to 19C, FIGS. 20A and 20B, FIG. 21 and FIGS. 23A to 23C relating to the third embodiment. This embodiment is the same as the third embodiment except that each of the wheels 12, 12 is slidable relative to the wheel shaft 13 in the axial direction of the shaft, similarly to the fourth and fifth embodiment.

As apparent from the above description, a truck wheel-spacing changing method, a variable wheel-spacing truck and a ground facility therefor according to the present invention have various advantages as follows.

According to a truck wheel-spacing changing method of the present invention, the truck can be self-propelled without external driving power during a wheel-spacing changing operation at a junction between wide and narrow track gauges. Furthermore, a wheel-spacing changing operation can be surely executed while passengers or baggages are carried in the vehicle; the stability in running after completing the wheel-spacing change is not inferior to that of a conventional truck of a fixed wheel-spacing type; and the ground facility has also a simple structure.

According to a variable wheel-spacing truck of the present invention, a tracted truck having no driving power may have substantially the same structure as a self-propelled truck. In consequence, a conversion from a self-propelled truck into a tracted truck or from a tracted truck into a self-propelled truck is simple and can be applied to all passenger trains, electric locomotives, and diesel railcars.

Especially, in case that the both of a pair of wheels are adapted to slide together with the associated bogie frames (side beams) relative to the wheel shaft, the length of the wheel shaft projecting outwards from the truck on a narrower track gauge is rather short, and accordingly, the wheel shaft can be easily accommodated within the width of the vehicle.

A ground facility according to the present invention is composed of rails and running paths, or of rails, running paths and guide rails, which are all rigid and include no moving parts. In consequence, excellent durability and easy maintainance can be assured, thereby making the ground facility suitable as an outdoor facility usable for a long time in a stable condition.

What is claimed is:

1. A method of changing a wheel-spacing of a truck while the truck runs from a first railway having a first track gauge into a second railway having a second track gauge different from the first track gauge through a junction railway connecting the first and second railways, comprising:

providing a truck including a pair of bogie frames which are movable relative to each other and able to be fixedly connected by a releasable locking means and a pair of wheels at least one of which is slidable relative to a wheel shaft of the truck in an axial direction of the wheel shaft, pushing upwards an auxiliary wheel of the locking means by a running path means engaging with the auxiliary wheel, when the truck moves from the first railway into the junction railway, to release the locking means and to maintain the locking means in an unlocked condition, applying a pushing force to the at least one slidable wheel of the truck by a pair of guide rails of the junction railway or by a pair of rails of the first and second railways, when the truck moves through the junction railway having a varying track gauge, so as to transversely shift the pair of bogie frames rotatably supporting the wheels relative to each other by use of the pushing force, lowering the auxiliary wheel of the locking means, after a predetermined amount of movement of the pair of bogie frames has been completed, by use of the running path means engaging with the auxiliary wheel, thereby activating the locking means into a locking condition and maintaining the locked condition, and then, moving the truck from the junction railway into the second railway, thereby completing the truck wheel-spacing changing operation, wherein the bogie frames are each substantially T-shaped and each have a transom with an end portion overlapping with a side beam of the other bogie frame, a pair of vehicle supporting means are mounted on the pair of bogie frames, each of the supporting means including an elastic body, the locking means include the auxiliary wheel and are capable of locking the pair of bogie frames at plural transverse positions to establish the locking condition and of releasing the locking condition, and axle boxes and supporting members are engaged with the bogie frames and support the wheels.

2. A truck wheel-spacing changing method as claimed in claim 1 wherein one of the pair of wheels is prevented from sliding relative to the wheel shaft in the axial direction of the wheel shaft and the other one of the wheels is allowed to slide relative to the wheel shaft in the axial direction.

3. A truck wheel-spacing changing method as claimed in claim 1, wherein both of the pair of wheels are allowed to slide relative to the wheel shaft in the axial direction of the wheel shaft.

4. A method of changing a wheel-spacing of a truck while the truck runs from a first railway having a first track gauge into a second railway having a second track gauge different from the first track gauge through a junction railway connecting the first and second railways, comprising:

raising a transversely extending transom of a first bogie frame of the truck to disengage the transom from a side beam of a second bogie frame of the truck;

applying a transverse force to a wheel of one of the bogie frames to transversely shift the first and second bogie frames relative to each other; and lowering the transom to reengage the transom with the side beam, thereby locking the first and second bogie frames with respect to each other.

5. A method according to claim 4 wherein raising the transom comprises pivoting the transom about a side beam of the first bogie frame from which the transom extends.

6. A method according to claim 4 including raising and lowering a transversely extending transom of the second bogie frame while raising and lowering the transom of the first bogie frame to disengage and reengage the transom of the second bogie frame from a side beam of the first bogie frame.

7. A method according to claim 4 wherein raising the transom, applying the transverse force, and lowering the transom are performed while the truck is moving along one or more of the first railway, the second railway, and the junction railway.

8. A method according to claim 4 wherein raising the transom comprises raising an auxiliary wheel connected to the transom using a running path extending along the junction railway.

9. A method according to claim 4 wherein the first bogie frame is substantially T-shaped.

10. A method according to claim 9 wherein the second bogie frame is substantially T-shaped.

* * * * *